US007181150B2

(12) United States Patent
Miyazaki

(10) Patent No.: US 7,181,150 B2
(45) Date of Patent: Feb. 20, 2007

(54) RESERVATION JOB SECURITY ESTABLISHED IMAGE FORMING APPARATUS, CONTROL PROGRAM, AND RECORDING MEDIUM

(75) Inventor: Ryonosuke Miyazaki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 273 days.

(21) Appl. No.: 11/001,015

(22) Filed: Dec. 2, 2004

(65) Prior Publication Data

US 2005/0135829 A1 Jun. 23, 2005

(30) Foreign Application Priority Data

Dec. 2, 2003 (JP) ..... 2003-403651

(51) Int. Cl.
*G03G 15/00* (2006.01)

(52) U.S. Cl. ..... 399/80

(58) Field of Classification Search ..... 399/80, 399/79

See application file for complete search history.

(56) References Cited

U.S. PATENT DOCUMENTS

2004/0139164 A1* 7/2004 Kanaya

FOREIGN PATENT DOCUMENTS

JP 2001-111743 4/2001

* cited by examiner

*Primary Examiner*—Susan Lee
(74) *Attorney, Agent, or Firm*—Oblon, Spivak, McClelland, Maier & Neustadt, P.C.

(57) ABSTRACT

An image forming apparatus includes an administrative device that stores and administrates authorization information in connection with an image formation job. The authorization information is used to determine if an operator is permitted to apply a prescribed operation to a reserved job. An authorization device requests an operator to input identification information while temporarily stopping execution of a previously reserved job. The authorization device performs authorization based upon the identification information when application of the prescribed operation is requested, and forwards the authorization. A control device validates the prescribed operation when the authorization device forwards the authorization.

20 Claims, 20 Drawing Sheets

| | | |
|---|---|---|
| JOB 1 | USER A | PASSWORD a |
| JOB 2 | USER B | PASSWORD b |
| JOB 3 | USER C | PASSWORD c |
| · | · | · |
| · | · | · |
| JOB N | USER Z | PASSWORD z |

| | | |
|---|---|---|
| ID : A | USER A | PASSWORD a |
| ID : B | USER B | PASSWORD b |
| ID : C | USER C | PASSWORD c |
| · | · | · |
| · | · | · |
| ID : Z | USER Z | PASSWORD z |

| | |
|---|---|
| JOB 1 | ID : A |
| JOB 2 | ID : A |
| JOB 3 | ID : C |
| · | · |
| · | · |
| JOB N | ID : A |

RESERVATION JOB SECURITY ESTABLISHED IMAGE FORMING APPARATUS, CONTROL PROGRAM, AND RECORDING MEDIUM

CROSS-REFERENCE TO RELATED APPLICATION

This patent document claims priority under 35 USC §119 to Japanese Patent Application No. 2003-403651 filed on Dec. 2, 2003, the entire contents of which are hereby incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

The present invention relates to image forming apparatuses, control methods implemented in the image forming apparatuses, control programs for controlling the image forming apparatus, and recording mediums storing the control programs, and in particular, to such image forming apparatuses, control methods, control programs, and recording mediums capable of executing a plurality of programs one after another using an authorization function.

2. Description of the Background Art

It is common that an image forming apparatus includes a plurality of functions, such as printing, copying, sending facsimile, scanning, etc., implemented by software, and such an apparatus is referred to as a multi-function machine. Each of these functions is generally implemented by switching the software from one to another.

An image forming apparatus can also include a job reservation function allowing a user to reserve an image formation job per an operation. Thus, a copying operation can be automatically advanced to the next job upon completion of the previously reserved job, when the next job is reserved using the job reservation function in the image forming apparatus. Specifically, an operator sets an original document on a reading section, and inputs and registers various reservation items, such as a number of copies, a copying mode (e.g., duplex or simplex), etc., through a display section. Thus, the reserved job can be automatically performed upon completion of the previously reserved job. Since a user can leave the image forming apparatus after he or she sets the original document on the reading section and completes the registration of the job, he or she is not needed to engage therewith any more during the printing. Thus, such a job reservation is significantly advantageous, in particular, when a plurality of jobs having a significantly large number of copies are executed.

The image forming apparatus also employs a setting change function of changing contents of a job. For example, a deleting function is typically included to delete a job when a reserved job becomes needless. Further, a priority changing function is sometimes employed to optionally change and give a priority to another reserved job to be processed prior to a previously reserved job. In such a circumstance, a user can freely change contents and a priority, and even delete a job, when a user exclusively uses an image forming apparatus. However, when the image forming apparatus is commonly used by a plurality of users, another user can change and delete setting and a priority of a job, which has been reserved by a prescribed authorization user, without his or her consent. When some settings are to be changed, the authorization user generally comes to realize either an abnormality or deletion by finding an output or a skip of the reserved job for the first time. In order to overcome such a problem, Japanese Patent Application Laid Open No. 2001-111743 discusses an image forming apparatus that requests a user to input a password to identify an authorization user and to determine if the user is permitted to change a reserved job.

The above-mentioned image forming apparatus generally includes a condition-setting device that sets a condition for an image formation job, a user registration device that registers a user ID (identification) and a password that collectively identify a user who is authorized to operate the apparatus, a job reservation device that allows a registered user to reserve an image formation job, a set condition changing device that changes a setting condition of the image formation job, and a user identifying device that requests a user to input a password, identifies the user based upon the input password, and either validates or invalidates an operation that changes the above-mentioned setting condition based upon the identification result. Thus, other users can be inhibited from changing or deleting an image formation job, which has been reserved by an authorized user, by requesting an input of a password of an authorized user, who has reserved the image formation job, when the image formation job is to be changed. However, when a password of a user is input upon request, an image formation job continues printing until the user is authorized in the background image forming apparatus. Further, when an inadequacy is included in a reserved job, and thus the job having started printing is to be quickly stopped, a password of an authorization user is necessarily input, resulting in erroneous copy continuation until the user is authorized.

SUMMARY OF THE INVENTION

Accordingly, an object of the present invention is to address and resolve such and other problems and provide a novel image forming apparatus.

The above and other objects are achieved by providing a novel image forming apparatus including: an administrative device that administrates authorization information used to permit an operator in connection with an image formation job to apply a prescribed operation to the image formation job; an image forming device that executes the image formation job; an authorization device that requests an input of the authorization information while temporarily stopping execution of the image formation job, and that performs authorization based upon the authorization information, and that forwards an authorization; and a control device that validates the prescribed operation when the authorization device forwards the authorization.

In another embodiment, an operational device is provided to apply the prescribed operation to the image formation job. In a preferred embodiment, the authorization device requests the input of the authorization information when the operational device starts applying the prescribed operation.

In yet another embodiment, the prescribed operation includes one of a print interruption operation to interrupt the image formation job, a continuing operation to continue the image formation job, and a content changing operation operative to change contents of the image formation job.

In yet another embodiment, the prescribed operation includes a selecting operation for selecting one of a print interruption operation for interrupting the image formation job, a continuing operation for continuing the image formation job, and a content changing operation for changing contents of the image formation job.

In yet another embodiment, a recommencing device is provided to recommence the image formation job when a content changing operation for changing contents of the image formation job is executed.

In yet another embodiment, the image formation device recommences the image formation job when a prescribed time has elapsed after the authorization device requests inputting of the authorization information, and the authorization device does not forward the authorization within a prescribed time.

In yet another embodiment, an alarm device is provided to output an alarm that the authorization is rejected, when the authorization device does not forward the authorization.

In yet another embodiment, a time setting device is provided to set a prescribed time for recommencing the image formation job.

In yet another embodiment, the authorization device determines if the authorization information, which is input upon the request, matches with authorization information administrated by the administrative device. In a preferred embodiment, the authorization is forwarded when the respective authorization informations match with each other, and is not forwarded when the respective authorization informations do not match with each other.

In yet another embodiment, a computer program causes a controller to execute: requesting an input of authorization information while temporarily stopping execution of an image formation job; performing authorization based upon the authorization information; and validating a prescribed operation to be applied to a reservation job when authorization is forwarded.

In yet another embodiment, a computer readable recording medium stores the computer program.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
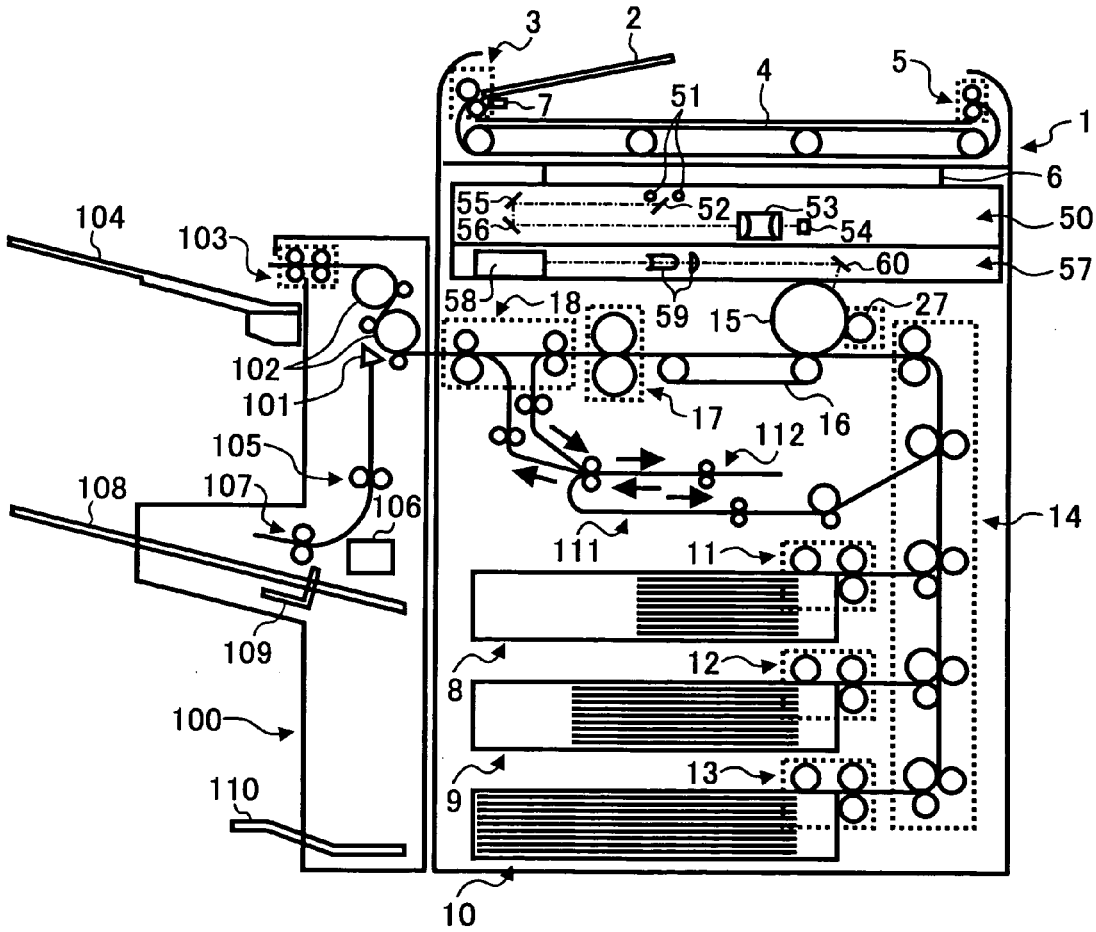
FIG. 1 illustrates a configuration of an exemplary image forming apparatus according to the present invention.

Referring now to the drawings, wherein like reference numerals designate identical or corresponding parts throughout the several views, and in particular to FIGS. 10A and 10B, an exemplary operation performed according to the present invention is described in summary, a more detailed explanation being provided below.

Figure 12:
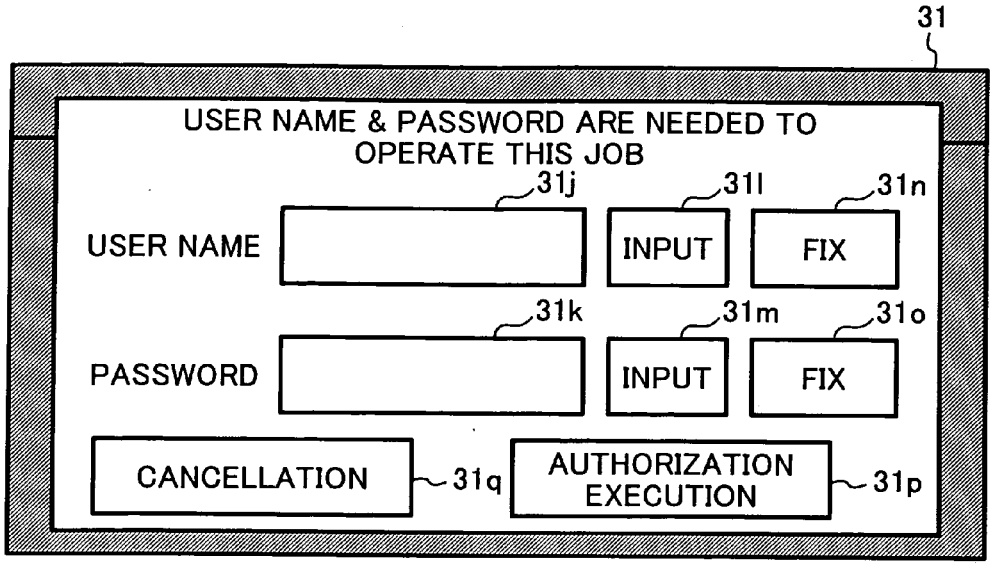
FIG. 12 illustrates an exemplary authorization request screen displayed on the liquid crystal touch panel of FIG. 3 when the interruption operation is executed.

When an image formation job in a process of copying is temporarily stopped by pressing a C/S (clear/stop) key (in step S1) in an image forming apparatus, sheet feeding is interrupted in step S3. Then, after a sheet rejection is completed in step S4 an authorization request screen is displayed on an operation section as illustrated in FIG. 12 to request an operator to obtain authorization in step S5. Further, a timer starts a timing until the operator inputs the requested information in step S6, and if the user does not input the requested information within the set time (NO in step S7) a copying operation is recommenced (in step S9) when the prescribed time has elapsed (Yes, in step S8).

Figure 13:
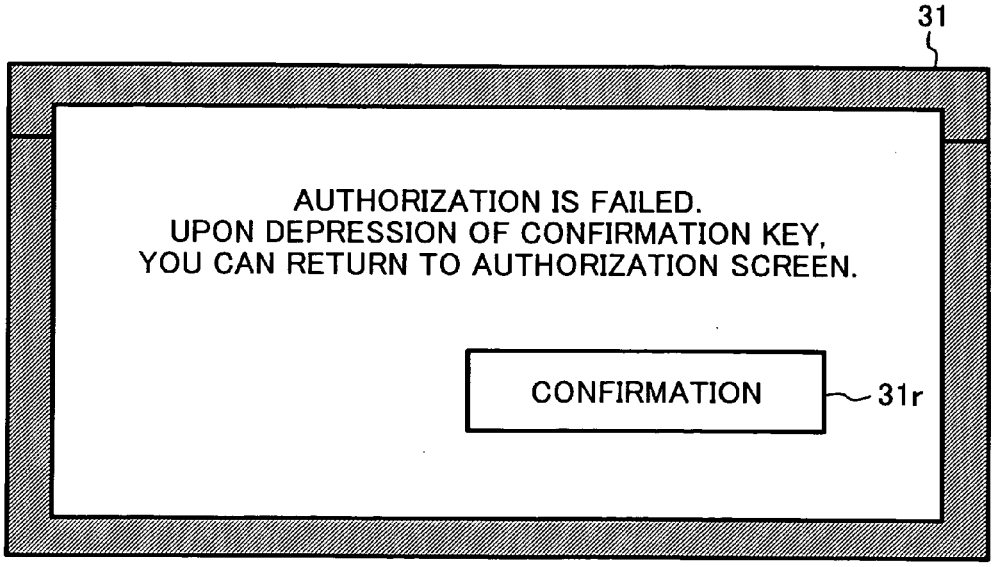
FIG. 13 illustrates an exemplary authorization failure screen displayed on a liquid crystal touch panel when the interruption operation is executed.
Figures 14, 15, 16A, 16B:
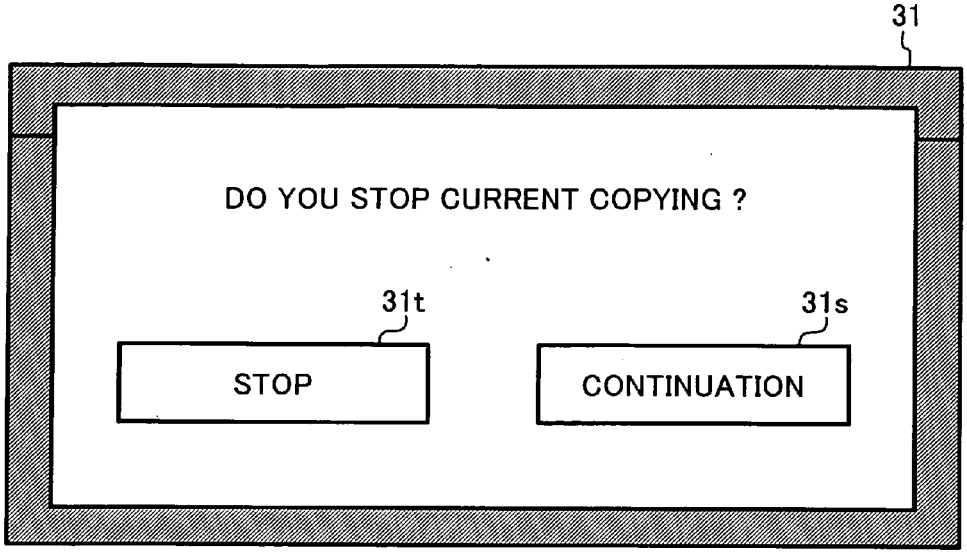
FIG. 14 illustrates an exemplary copy interruption screen displayed on the liquid crystal touch panel of FIG. 3 when the interruption operation is executed.
FIG. 15 illustrates a first exemplary user administrative table.
FIGS. 16A and 16B collectively illustrate a second exemplary user administrative table.

Further, when a user name and a password are input through the authorization request screen within the set time (Yes, in step S7), the running timer is stopped (in step S10), and the authorization is executed as to if the user name and password match with those having been registered in connection with the image formation job (in step S11). If it is determined that they match with each other (Yes, in step S11), the authorization request screen is closed, and a copy interruption screen as illustrated in FIG. 14 is displayed on the operation screen (in step S17). In contrast, if it is determined that they do not match with each other (No, in step S11), an authorization failure screen as shown in FIG. 13 is displayed (in step S12). When a confirmation key 31*r* displayed on the authorization failure screen is depressed (Yes, in step S14), the authorization request screen (of FIG. 12) is displayed again (in step S5). When a prescribed time has been elapsed without any operation (Yes, in step S15) the authorization failure screen is closed (in step S16).

Now, an exemplary image forming apparatus according to an embodiment of the present invention is described with reference to FIG. 1. The image forming apparatus includes an automatic document feeder 1, an original document table 2, a pair of feed rollers 3, a conveyance belt 4, a pair of delivery rollers 5, a contact glass 6, an original document set detection section 7, first to third trays 8, 9, and 10, first to third sheet feeding units 11, 12, and 13, a sheet conveyance unit 14, a photoconductive (PC) member 15, a conveyance belt 16, a fixing unit 17, a sheet ejection unit 18, a developing unit 27, a reading unit 50 formed from a contact glass 6, an exposure lamp 51, first to third mirrors 52, 55, and 56, a lens 53, and a CCD image sensor, a writing unit 57 formed from a laser output unit 58, an imaging lens 59, and a mirror 60, and a finisher 100 formed from a switching plate 101, a pair of ordinary sheet ejection rollers 102, a pair of conveyance rollers 103 and 105, an ordinary sheet ejection tray 104, a stapler 106, a pair of ejection rollers 107, a staple table 108, a jogger 109, a staple completion sheet ejection tray 110, a duplex sheet feeding unit 111, and a sheet inversion unit 112.

Now, an operation section 30 provided on the image forming apparatus is described with reference to FIG. 2. The operation section 30 includes a liquid crystal touch panel 31, ten-pad keys 32, a clear/stop key 33, a print key 34, a reset key 36, an initial setting key 37, and a log out key 38. Several keys are displayed on the liquid crystal touch panel 31 to indicate setting modes and messages representing conditions of the image forming apparatus.

The liquid crystal touch panel 31 can reversely display a key in black when a user selectively depresses the key. When a dot display function is used as a liquid crystal touch panel 31, a display can be optimum and graphical.

The initial setting key 37 optionally customizes an initial condition of the image forming apparatus when depressed. For example, a size of a sheet, which is contained in the image forming apparatus, and other conditions to be set after the reset key 36 is depressed can be determined. The initial setting key 37 also sets details of various functions, which are displayed on the liquid crystal touch panel 31. Specifically, a type of an integration partition line can be selectively set, when an integration copy key formed on the liquid crystal touch panel 31 is depressed.

Figure 3:
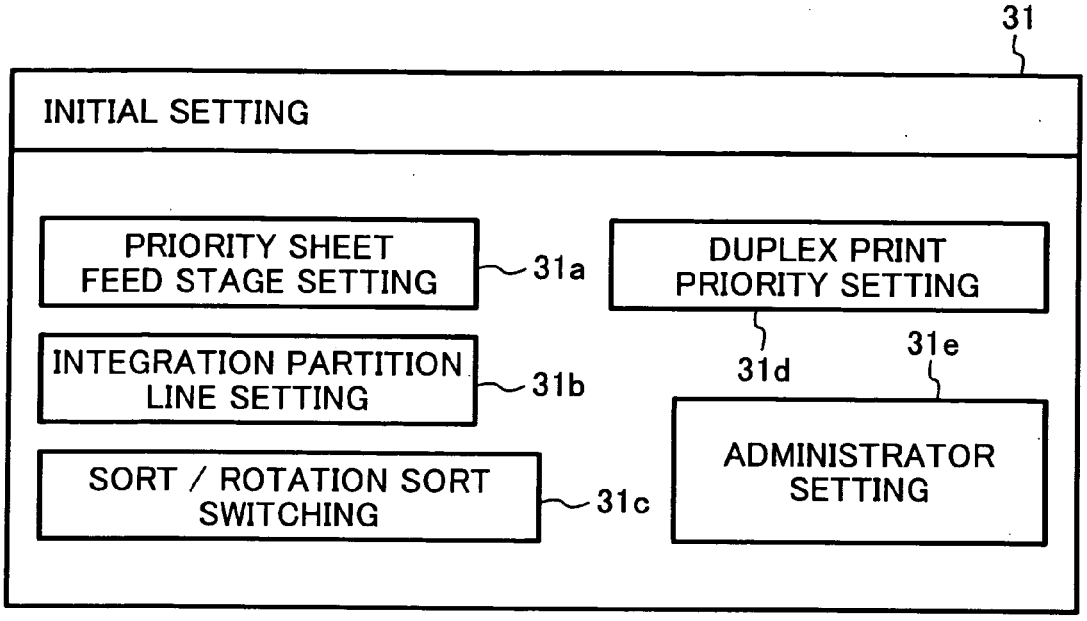
FIG. 3 illustrates an exemplary initial setting screen displayed on a liquid crystal touch panel provided on the operational section of FIG. 2.

Further, FIG. 3 illustrates an exemplary display, which appears on the liquid crystal touch panel 31 when the initial setting key 37 is depressed. As shown, a priority sheet feeding stage setting key 31*a*, an integration partition line setting key 31*b*, a sort/rotation sort switching key 31*c*, a duplex printing priority setting key 31*d*, and an administrator setting key 31*e* are displayed on the liquid crystal touch panel 31 when the initial setting key 37 is depressed.

Figure 4:
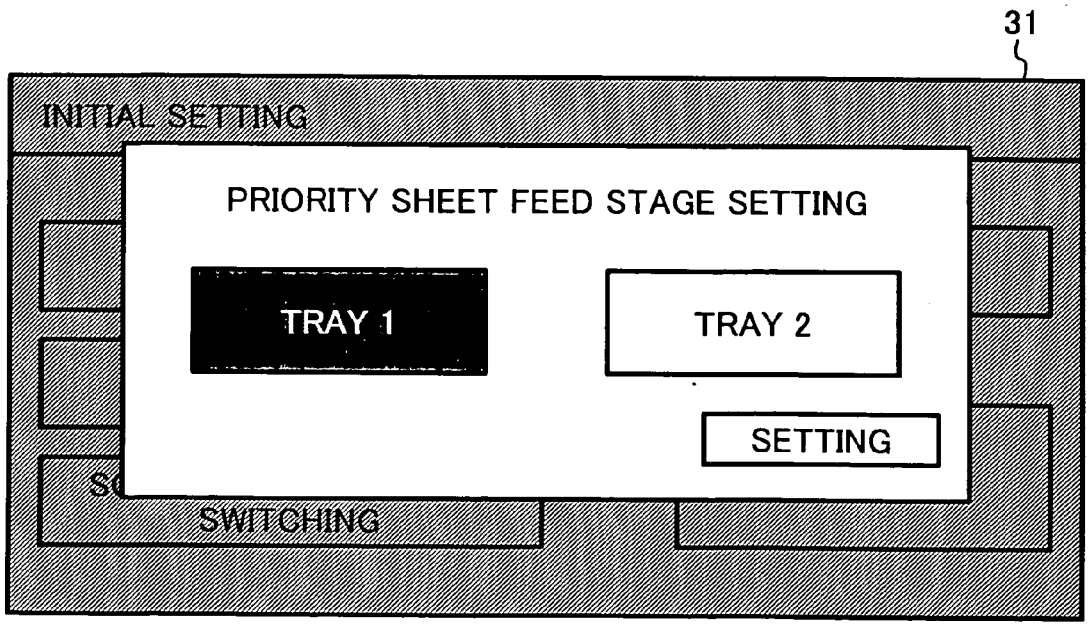
FIG. 4 illustrates an exemplary priority sheet-feeding tray setting screen displayed on the liquid crystal touch panel provided on the operational section of FIG. 3.

The priority sheet feeding stage designating key 31*a* allows an operator to designate a sheet feeding stage, which is automatically selected ordinarily when either the image forming apparatus is started or the reset key 36 is depressed. Specifically, when the priority sheet feeding stage designating key 31*a* is depressed, a priority sheet feeding stage-setting screen as shown in FIG. 4 is displayed on the liquid crystal touch panel 31 showing a condition that a tray 1 is designated as a default. Then, when the tray 1 is selected and the setting key is depressed, the tray 1 is definitely designated. The integration partition line setting key 31*b* designates a type of a partition line such as a dotted line, a solid line, etc., to be added when a copy is executed.

The sort/rotational sort switching key 3*c* switches a sort key from a sort to a rotational sort, and vice versa.

Figure 2:
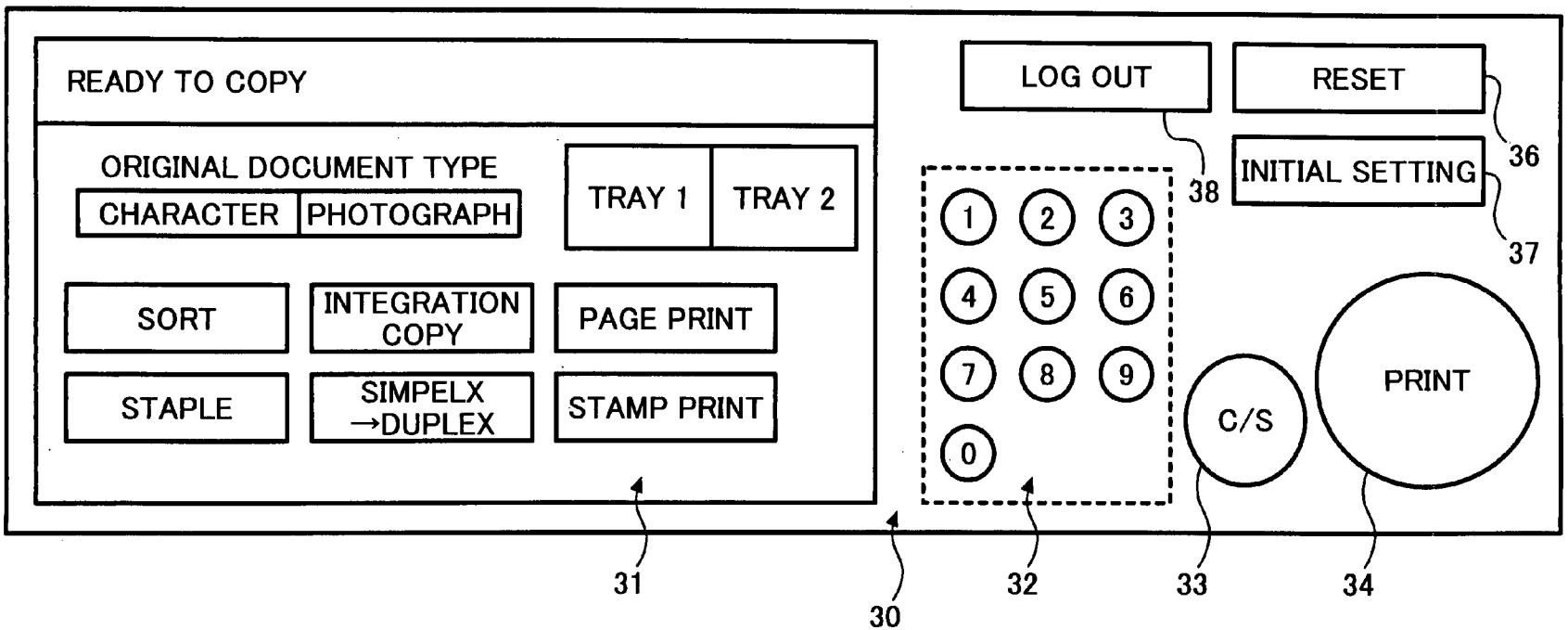
FIG. 2 illustrates a configuration of an exemplary operational section of the image forming apparatus of FIG. 1 according to the present invention.
Figure 5:
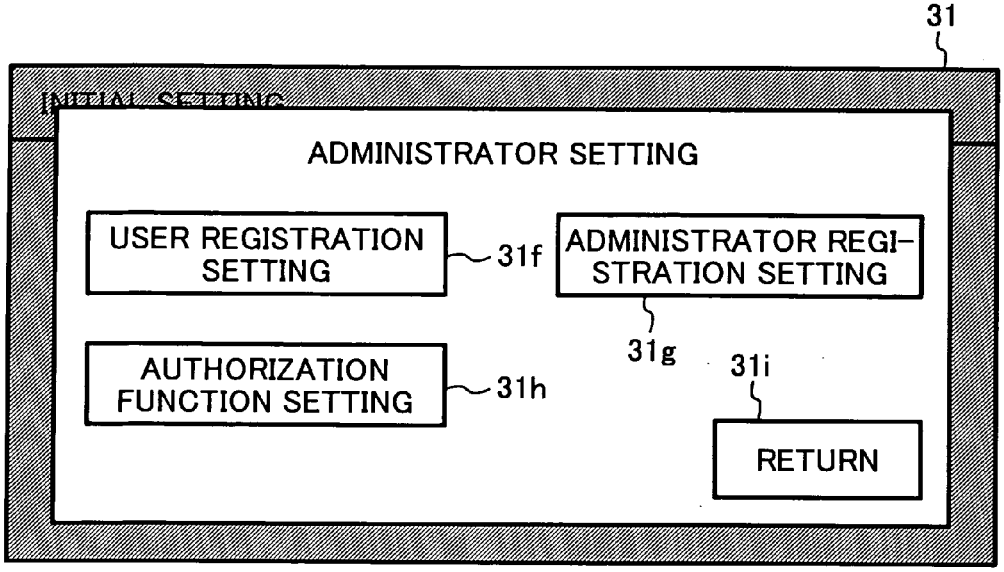
FIG. 5 illustrates an exemplary administrator setting screen displayed on the liquid crystal touch panel of FIG. 3.

The duplex printing priority setting key 31*d* sets as to if a simplex/duplex mode displayed on the liquid crystal touch panel 31 is selected when the image forming apparatus is started or the reset key 36 of the operation section of FIG. 2 is depressed. The administrator setting key 31*e* sets administrator information. Specifically, an administrator setting screen illustrated in FIG. 5 is displayed on the liquid crystal touch panel 31 when the administrator setting key 31*e* is depressed. When a user registration setting key 31*f* displayed on the administrator setting screen is depressed, user ID information can be newly registered or deleted. As administrative information, a user name, and a password can be registered per a user. Further, an administrator registration setting key 31*g* can set and designate only a person among registered users. The authorization function setting key 31*h* enables a user to use an authorization function. The return key 31*i* allows returning to a previous display. When image formation is started without using the authorization function, a screen illustrated in FIG. 6 is displayed on the liquid crystal touch panel 31.

Figure 6:
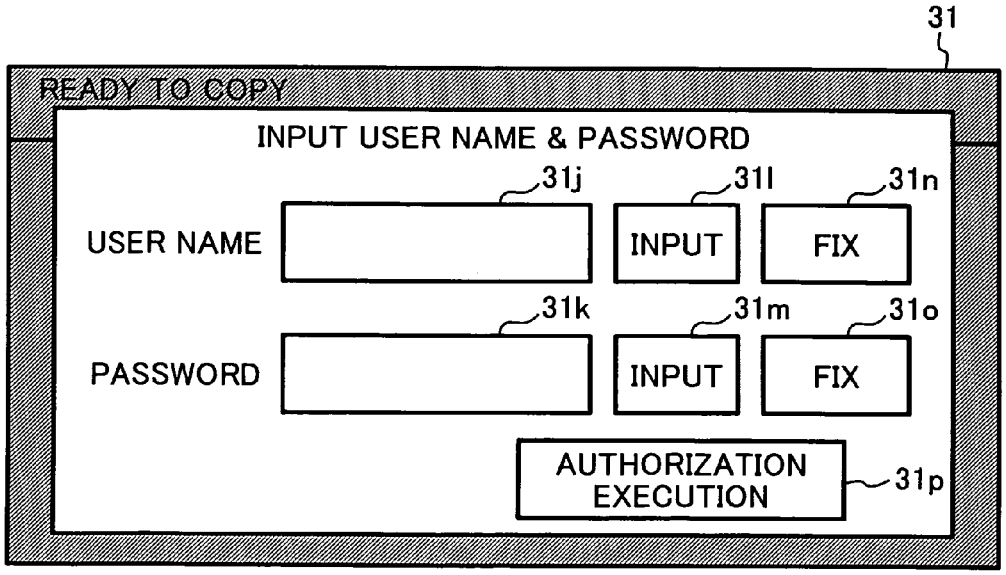
FIG. 6 illustrates an exemplary authorization request screen displayed on the liquid crystal touch panel of FIG. 3.

Thus, when a use name input key 31I displayed on the screen of FIG. 6 is depressed, inputting of a user name becomes available. Depressing ten-key pads 32 can input the user name. When a confirmation or fix key 31*n* displayed on the screen of FIG. 6 is depressed, the inputting of the user name is completed. After that, a user name cannot be input anymore until the input key 31I is depressed, even if the ten-key pads 32 are depressed. The user name is displayed on a display region 31*j* of the screen of FIG. 6. Further, a password can similarly be input as the user name, by using keys 31*m* and 31*o*, and displayed in region 31*k*. However, only asterisks having the same number of letters as the password are displayed.

When the user name and the password are input, the confirmation or authorization execution key 31*p* is depressed, and if the user name and the password match with those having been registered and administrated in the image forming apparatus, the user name is given an authorization, and a login is completed. Then, the screen of FIG. 6 is closed, and the screen on the liquid crystal touch panel 31 is displayed again. To cancel the authorizing status, a log out key 38 provided in the operation section 30 is depressed. When the log out key 38 is depressed, the screen displayed on the liquid crystal touch panel 31 returns to that of FIG. 6.

Figure 7:
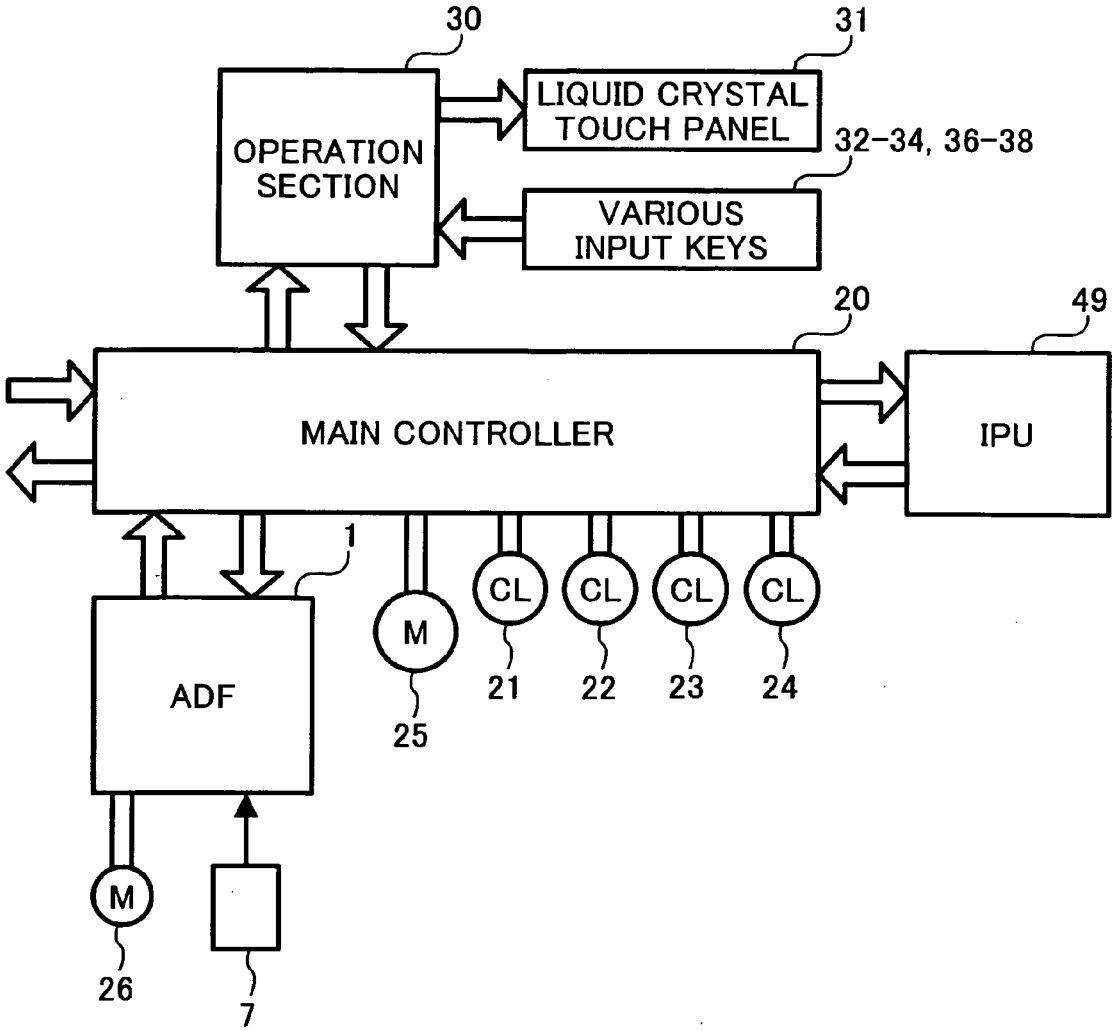
FIG. 7 illustrates an exemplary control system employed in the image forming apparatus of FIG. 1 according to the present invention.

Now a control system of the image forming apparatus is described with reference to FIG. 7. A control system of the image forming apparatus includes a main controller 20, which generally controls the image forming apparatus and other decentralized control apparatuses. An image processing unit (IPU) 49, an ADF 1, and an operation section 30 are connected to the main controller 20 via a system bus. The operation section 30 displays information to allow an operator to set a prescribed function. The IPU 49 controls an operation of a scanner, writing of an image of an original document in an image memory, which is included in the IPU, and formation of a visual image based on data, which is stored in the image memory. A main motor 25, an intermediate clutch 21, and first to third sheet feeding clutches 22 to 24 are directly connected to the main controller 20. A conveyance motor 26 and an original document set detecting section 7 are connected to the ADF 1. A liquid crystal display 31 and various inputting keys 32 to 34 and 36 to 38 are connected to the operation section 30. Now, an exemplary operation executed in the image forming apparatus of the present invention is described with reference to FIGS. 1 and 7.

Initially, an original document stack is set on an original document table 2, which is provided on the ADF 1, with image surfaces facing up. The original document is fed by a sheet feeding roller 3 and a conveyance belt 4 from the bottom most original document toward a prescribed position on a contact glass 6. The image forming apparatus includes a counting function, which counts a number of original documents when each one of the original documents is conveyed.

Then, a reading unit 50 reads an image of the original document at the prescribed position. The conveyance belt 4 and a pair of ejection rollers 5 then eject the original document. Further, when the original document set detecting section 7 detects a subsequent original document on the original document table 2, the subsequent original document is fed onto the contact glass 6 in the similar manner to the above-mentioned original document-feeding manner. A conveyance motor 26 drives the sheet-feeding roller 3, the conveyance belt 4, and the sheet ejection rollers 5.

Stacks of transfer sheets set on first to third trays 8 to 10 are fed by first to third sheet feeding apparatuses, and are further conveyed by a longitudinal conveyance unit 14 to a position where the transfer sheet contacts the PC member 15. The image data, which is read by the reading unit 50, is written to the PC member 15 by a laser, which is emitted from a writing unit 57, and becomes a toner image in a developing unit 27. Then, the transfer sheet receives the toner image from the PC member 15 while being conveyed by the conveyance belt 16 at the same speed as the rotational speed of the PC member 15. The image on the transfer sheet is then fixed by a fixing unit 17 and is ejected onto a finisher 100 serving as a post processing apparatus by a sheet ejection unit 18. The finisher 100 may guide the transfer sheet either to an ordinary sheet ejection tray 104 or a staple table 108. By positioning a switching plate downwardly, the transfer sheet can be ejected to the ordinary sheet ejection tray 104 via the conveyance rollers 103. Specifically, by positioning the switching plate upwardly, the transfer sheet can be conveyed to the staple table 108 via the conveyance rollers 105 and 107.

A jogger 109 aligns one end of the transfer sheets, which are stacked on the staple table 108, every time a transfer sheet is ejected, and transfer sheets are stapled by a stapler 106 upon completion of a set of copies. A group of the stapled transfer sheets then drops into a staple completion sheet ejection tray 110 by gravity.

The ordinary sheet ejection tray 104 moves back and forth per either an original document or a number of copies sorted by an image memory to sort incoming copy sheets with a simple mechanism. When a duplex copy is to be formed on both sides, a transfer sheet is fed from each of the sheet feeding trays 8 to 10 and carries an image, and is not guided to the sheet ejection tray 104. The transfer sheet is rather temporarily stocked in a duplex sheet-feeding unit 111 via an inversion unit 112, while a switching plate (not shown) is set upwardly. Then, the transfer sheet is fed again to receive transfer of another toner image, which is formed on the PC member 15. While setting the switching plate downwardly, the transfer sheet having toner images transferred on both sides is guided to the sheet ejection tray 104. Thus, the duplex sheet-feeding unit 111 is utilized when images are formed on both sides of a transfer sheet.

The main motor 25 drives all of the PC member 15, the conveyance belt 16, the fixing unit 17, the sheet ejection unit 18, and the developing unit 27. Driving forces of the main motor 25 are transmitted to the sheet feeding apparatuses 11 to 13 through sheet feeding clutches 22 to 24, respectively. Further, driving forces of the main motor 25 are transmitted to the longitudinal conveyance unit 14 through an intermediate clutch 21. Operations of reading and writing an original document are now described.

The reading unit 50 includes a contact glass 6, which holds an original document, and an optical scanning unit. The optical scanning unit includes an exposure lamp 51, a first mirror 52, a lens 53, and a CCD image sensor 54. The exposure lamp 51 and first mirror 52 are secured to a first carriage (not shown). The second and third mirrors 55 and 56 are secured to a second carriage (not shown). When an image of the original document is read, the first and second carriages are mechanically moved at relative speeds, i.e., two versus one, to maintain a prescribed length of an optical path. A scanner driving motor (not shown) drives the optical scanning unit. Further, the image is read by the CCD image sensor 54 and is converted into an electric signal.

The writing unit 57 includes a laser output unit 58, an imaging lens 59, and a mirror 60. The laser output unit 58 houses a laser diode (not shown), serving as a laser light source, and a polygonal mirror, which is constantly rotated by a motor at a high speed.

When an image is to be written onto the PC member 15, a laser light is emitted from the writing unit 57 to the PC member 15 serving as an image formation system. A beam sensor is arranged in the vicinity of one end (not shown) of the PC member 15 to generate a main scanning synchronization signal.

Figure 8:
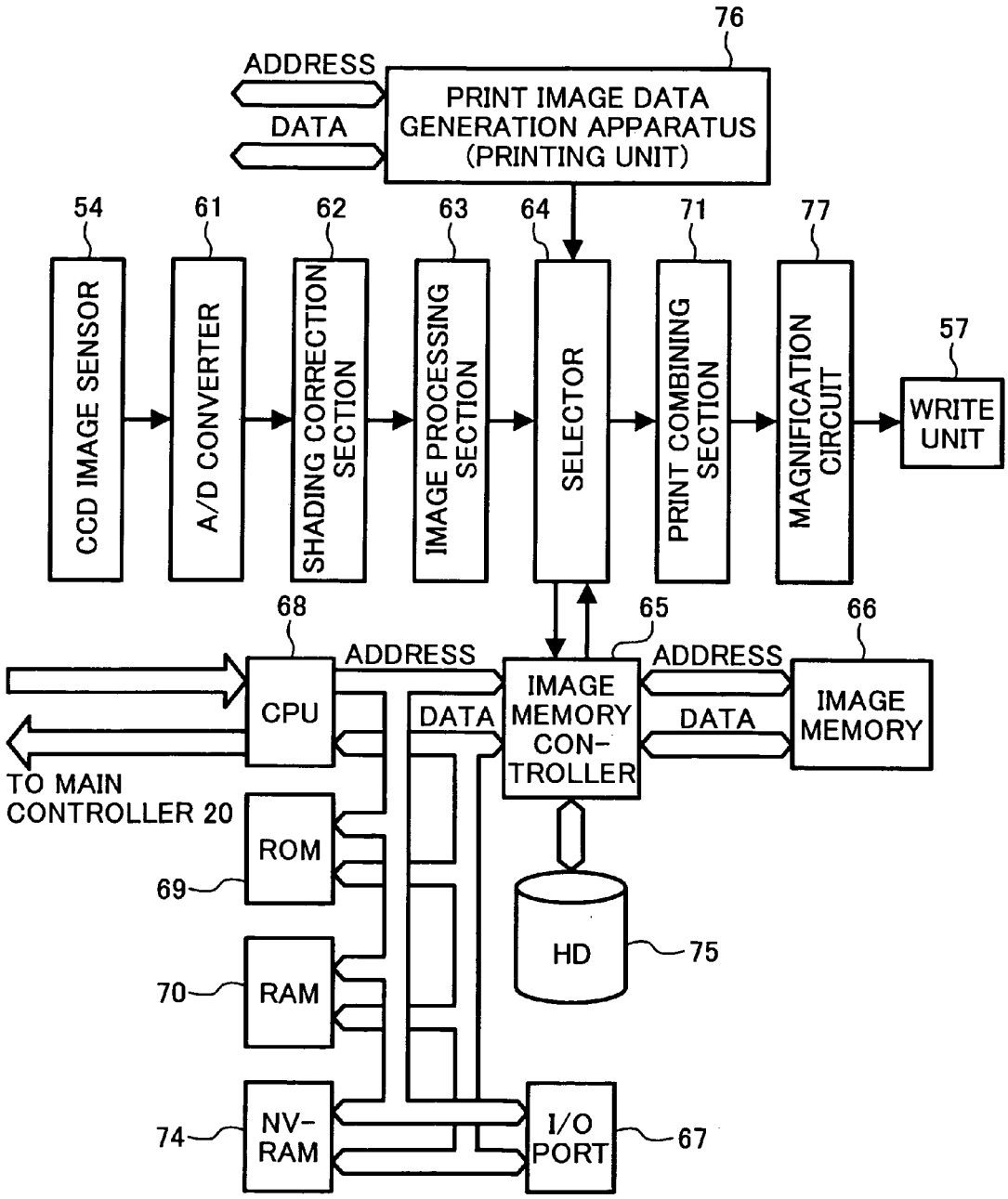
FIG. 8 illustrates an exemplary image processing section included in the image forming apparatus of FIG. 1 according to the present invention.

Referring now to FIG. 8, an operation of an image-processing unit IPU 49 is described with reference to FIG. 7. The image-processing unit IPU 49 converts a light, which is emitted from the exposure lamp 5 and is reflected by the original document, into electricity using the CCD image sensor 54, and then to a digital image data using an analog to digital converter 61. The image-processing unit IPU 49 applies shading correction to the digital image data in a shading correction section 62. The image-processing unit IPU 49 further applies MTF and Gamma corrections and a similar processing to the image data in the image processing section 63. The image data having received the MTF and Gamma corrections and the like is input to either an image memory controller 65 or a print combination section 71 in accordance with a switching operation of a selector 64. The image data output from a print image data generation apparatus is similarly input to either the image memory controller 65 or the print combining section 71 in accordance with a switching operation of the selector 64. The print combining section 71 combines the image data input from the image processing section 63 via the selector 64 with that input from the print image data generation apparatus, and transmits the print combination data to a magnification circuit 77. The image data now in the magnification circuit 77 can be either enlarged or reduced in accordance with a magnification, and is transmitted to the writing unit 57.

It is designed that image signals are mutually communicated between the image memory controller 65, which constitutes the image processing unit IPU 49, and the selector 64. Although not specifically illustrated in FIG. 8, the IPU 49 is enabled to selectively process one or more inputs and outputs of image data, which is externally transmitted and received via the I/O port 67, for example to and from an information processing apparatus, such as a personal computer, etc., beside the image data input from the reading unit 50.

Further, as shown in FIG. 8, the IPU 49 includes a CPU 68, which controls the reading unit 50 and the writing unit 57 as well as the image memory controller 65, a ROM 69, a RAM 70, and a NV-RAM 74, which store various programs and data used by the CPU 68. The CPU 68 controls data reading and writing from and to the image memory 66 via the image memory controller 65. All of registered user information, administrator information, and other initially set information are stored in the NV-RAM 74, and are thus continuously stored therein even after power supply for the image forming apparatus is turned off.

Further, the image data is sent to the image memory controller 65 and can be compressed there by an image compression apparatus. The image data can be further sent to the image memory 66. The purpose of image data compression is to enable efficient utilization of a limited capacity of the image memory 66 on one hand. That is, if image data having maximum image size, i.e., 256 gradations, is written into the image memory 66 as is, the image data largely occupies the image memory 66. On the other hand, since a lot of image data can be stored in the image memory 66 at once, the image data stored in the image memory 66 can be output in order of pages, thereby a sort function is performed. An expanding apparatus, which is included in the image memory controller 65, expands and outputs the image data one after another when the image data stored in the image memory 66 is output. Such a function is generally called an electronic sort.

The CPU 68 can access and thus process the image data stored in the image memory 66. For example, the mage data can be thinned, cut out, and so on. The image data is processed when written in a register included in the image memory controller 65, and is restored in the image memory 66.

The image memory 66 can be divided into a plurality of regions corresponding to a size of image data to be processed, and is designed to simultaneously receive and output image data. To this end, a pair of address/data lines for reading and writing image data is employed as interfaces, which are connected to the image memory controller 65. Thus, when image data is input, i.e., written, into a first region, a second region can simultaneously output image data, i.e., the image is read. To store a lot of image data, a hard disc (HD) 75 can be employed (also as the image memory 66) as shown in FIG. 8 to substantially permanently store image data without an external power supply. To read and store a plurality of original documents having a prescribed format (a format original document) by a scanner, the HD 75 may be most typically utilized.

To absorb a difference in a processing speed between an image formation process of the image forming apparatus and an image writing process of the scanner, both of the writing and reading processes of the image data are executed after image data is temporarily stored in the image memory 66 by the same reason. Further, image data can be sent to the writing unit 57 from the HD 75 after being temporarily stored in the image memory 66.

In accordance with inputting and outputting of image data, a flow direction of the image data is switched by the memory controller 65. Further, a path for inputting and outputting image data to and from an image data storage apparatus, such as an image memory 66, a HD 75, etc., and a writing unit 57 is determined by the image memory controller 65.

Figure 9:
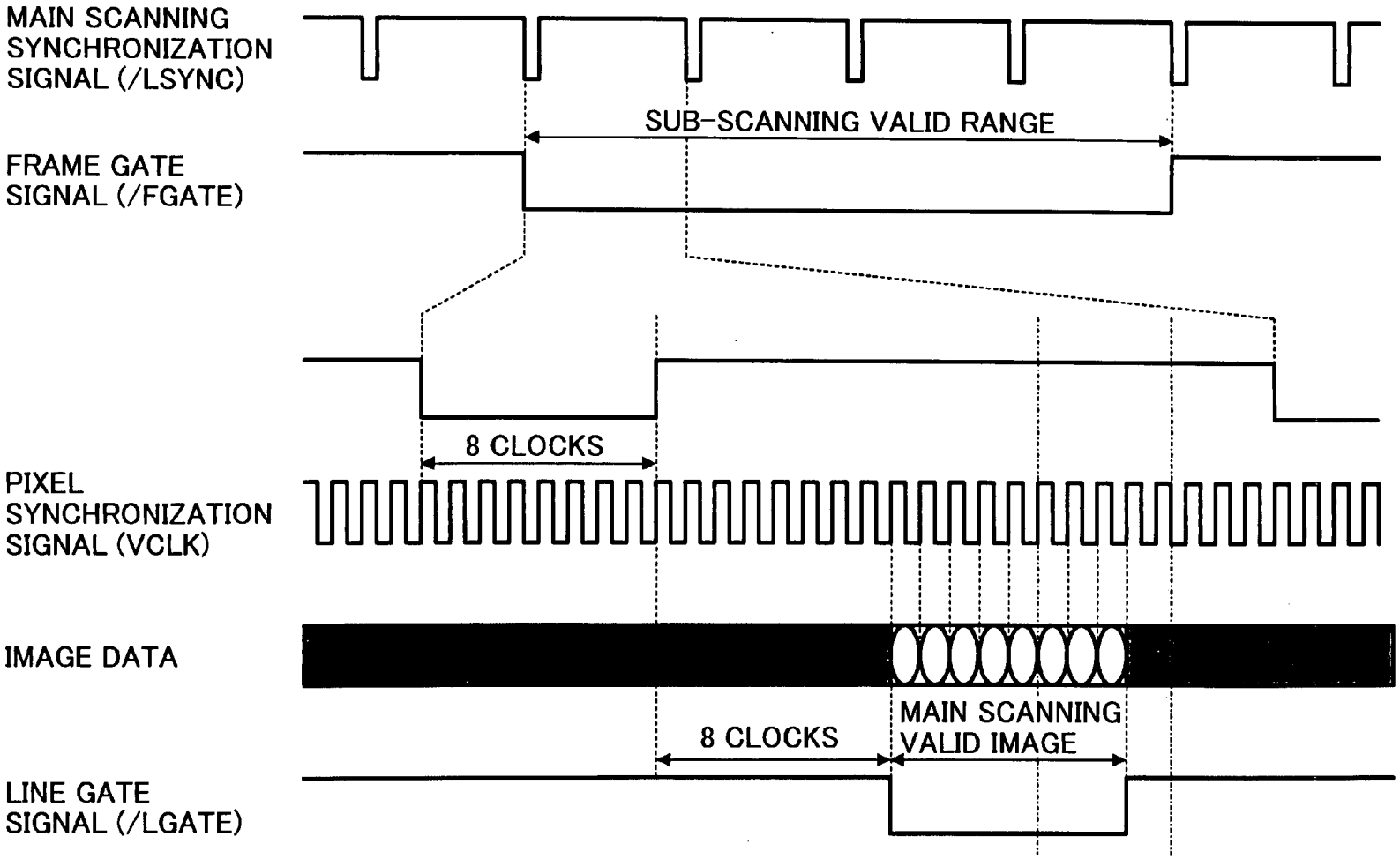
FIG. 9 illustrates exemplary signal generation times, when one page of image signals is processed.

Now, a processing of image signals of one page value, which is performed in a selector 64 of FIG. 8, is described with reference to FIG. 9. A frame gate signal (/FGATE) represents a valid term in a sub scanning direction of image data of one page value. A main scanning synchronization signal (/LSYNC) represents a main scanning synchronization signal per a line. A prescribed clock appearing after the main scanning synchronization signal rises validates an image signal. A line gate signal (/LGATE) represents that an image signal in the main scanning direction is valid. These signals synchronize with a pixel synchronization signal (VCLK). Data of eight bits (i.e., 256 gradations) per a pixel is transmitted per one cycle of the pixel synchronization signal (VCLK). A density of writing into a transfer sheet can be 400 dpi. A maximum number of pixels can be 4800 in a main scanning direction, and 6800 in a sub scanning direction. An image increasingly becomes white as gradation approaches 255 levels.

Now, an interruption operation performed in an exemplary image forming apparatus of a first preferred embodiment is described. In a background image forming apparatus, an authorization request screen of FIG. 6 is displayed on a liquid crystal touch panel 31 in the operation section 30, when none of users logs in. At that time, a copying operation is performed for a previous user, who has logged in, while the authorization request screen is displayed on the liquid crystal touch panel 31. Thus, even if the next user logs in through the authorization request screen, the copying operation is continued. In such a background image forming apparatus, a job of image formation in execution can be interrupted only when all of the clear/stop key 32 is depressed, both a user name and a password are input through the authorization request screen, and the authorization is successful.

According to the preferred embodiment, when a clear/stop key 32 is depressed, an image formation job, which is logged in and in execution, is temporarily stopped, and then a user name and a password are requested to be input through an authorization request screen, as described below.

Now, a processing performed in an exemplary image forming apparatus of one embodiment of the present invention is described with reference to FIGS. 10 and 11.

Initially, when the main controller 20 detects that the clear/stop (C/S) key 32 is depressed (in step S1), the main controller 20 determines if a copy operation is running (in step S2). If the determination is positive (Yes, in step S2), the main controller 20 interrupts sheet feeding, and ejects a sheet either remaining in the image forming apparatus or on the way of conveyance (in step S3).

Subsequently, the main controller 20 determines if sheet ejection is completed (in step S4). If the determination is positive (Yes, in step S4), the main controller 20 displays the authorization request screen (of FIG. 12) on the liquid crystal touch panel 31 (in step S5). The main controller 20 then starts timing with a timer (in step S6). Then, the main controller 20 determines if an authorization execution key 31*p* displayed on the authorization request screen is depressed (in step S7). If it is negative (No, in step S7), the main controller 20 determines if a prescribed time has elapsed after starting the timing (in step S8). If the determination is positive (Yes, in step S8), the main controller 20 stops the timing, and recommences the copying operation. The main controller 20 then closes the authorization request screen, and recalls the display screen of FIG. 2 (in step S9). If the determination is negative (No, in step S8), the process returns to step S7, and the main controller 20 determines if the authorization execution key 31*p* is depressed (in step S7).

In contrast, if the determination in step S7 is positive (Yes, in step S7), the main controller 20 stops the timing (in step S10), and determines if a user name and a password, which are input through the authorization request screen, match with those having been registered in connection with the running image formation job (in step S11). If the determination is negative (No, in step S11), the main controller 20 closes the authorization request screen, and displays an authorization failure screen as illustrated in FIG. 13 on the liquid crystal touch panel 31 (in step S12).

Subsequently, the main controller 20 starts timing (in step S13), and determines if a confirmation key 31*r* displayed on the authorization failure screen is depressed (in step S14). The main controller 20 stops the timing, and the process returns to step S5, if the determination is positive (Yes, in step S14). The main controller 20 then displays the authorization request screen of FIG. 12.

Further, if the determination in step S14 is negative (i.e., No, in step S14), the main controller 20 determines if a prescribed time has elapsed after starting the timing (in step S15). If the determination is positive (Yes, in step S15), the main controller 20 stops the timing, recommences a copying operation, closes the authorization failure screen, and recalls the display screen of FIG. 2 (in step S16). Further, if the determination is negative in step S15 (No, in step S15), the process returns to step S14. Then, the main controller 20 determines if the confirmation key 31*r* displayed on the authorization failure screen is depressed.

In contrast, if the determination of step S11 is positive (Yes, in step S11), the main controller 20 closes the authorization request screen of FIG. 12, and displays a copy interruption screen as illustrated in FIG. 14 displayed on the liquid crystal touch panel 31 in step S17).

Figure 11:
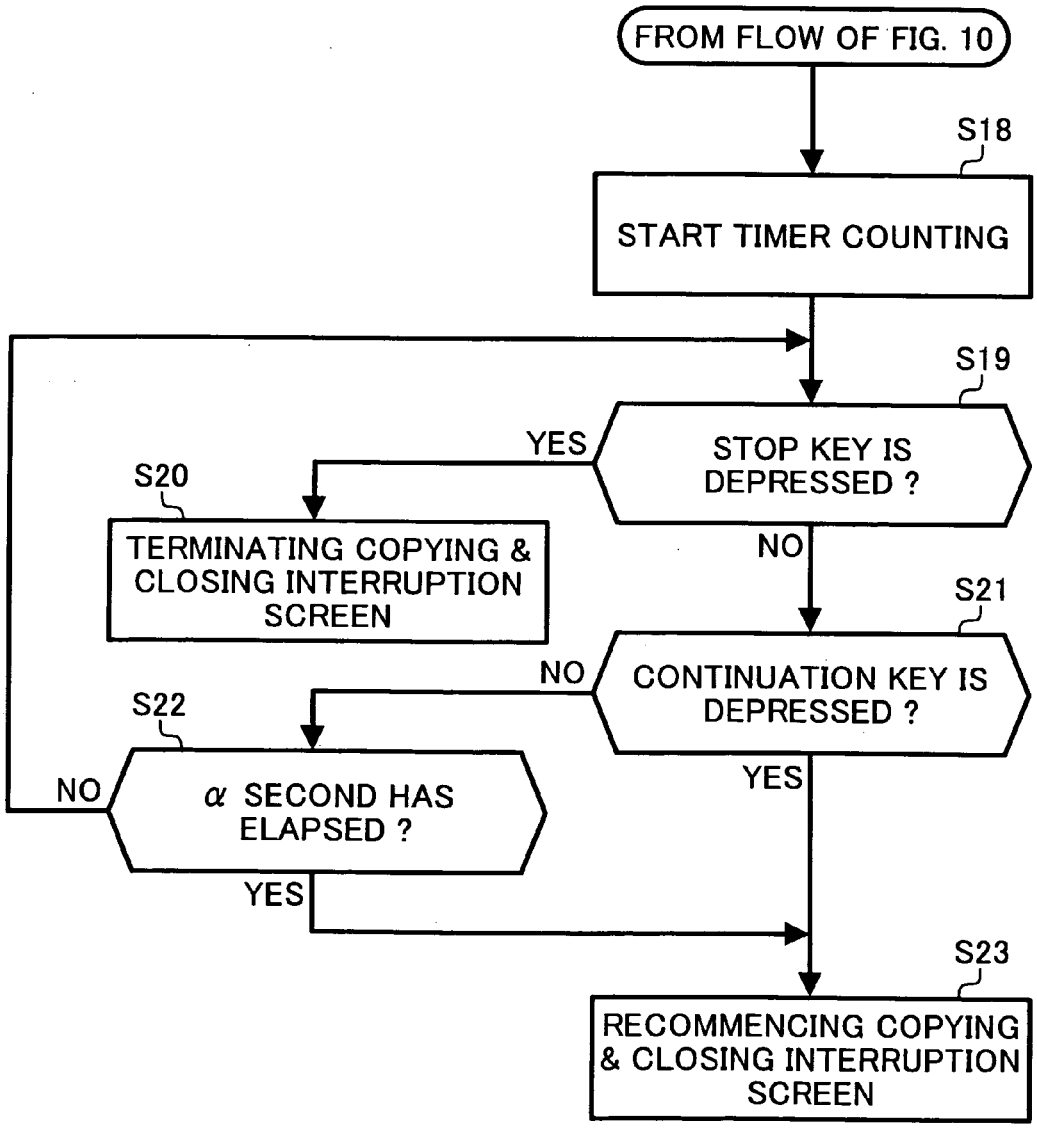
FIG. 11 illustrates a second operation of an interruption performed in the image forming apparatus of FIG. 1 according to the present invention.

Subsequently as illustrated in FIG. 11, the main controller 20 starts timing (in step S18), and determines if a cancel or stop key 31*t* displayed on the copy interruption screen is depressed (in step S19). If the determination is positive (Yes, in step S19), the main controller 20 stops the timing, and stops and completes the copying operation. The main controller 20 then closes the copy interruption screen and recalls the display screen of FIG. 2 (in step S20).

Further, if the determination is negative in step S19 (i.e., No, in step S19), the main controller 20 determines if a continue key 31*s* displayed on the copy interruption screen is depressed (in step S21). If the determination is negative (No, in step S21), the main controller 20 determines if a prescribed time has elapsed after starting the timing (in step S22). If the determination is negative (No, in step S22), the process returns to step S19. Then, the main controller 20 determines if the cancel or stop key 31*t* is depressed in step S19.

Further, if either the determination in step S21 or step S22 is positive (i.e., Yes, in step S21 or S22), the main controller 20 stops the timing, recommences a copying operation, closes the copy interruption screen, and recalls the display screen of FIG. 2 (in step S23).

In summary, when the clear/stop (C/S) key 33 is depressed, sheet feeding is stopped, and a sheet either on the way of image forming or conveyance, i.e., remaining in the image forming apparatus, is ejected. When the sheet ejection is completed, the authorization request screen of FIG. 12 is displayed on the liquid crystal touch panel 31. A timer then starts timing an operation absence. If it is determined that a prescribed time period has elapsed without any operation, the authorization request screen is closed, and a copy operation is continued.

Further, if the authorization execution key 31*p* displayed on the authorization request screen is depressed, the running timer is stopped, and it is determined if a user name and a password, which are input through the authorization request screen, match with those registered in connection with an image formation job in execution of printing. If the matching is confirmed, the authorization request screen of FIG. 12 is closed, and the copy interruption screen of FIG. 14 is displayed on the liquid crystal touch panel 31. If mismatching is confirmed, the authorization failure screen of FIG. 13 is displayed. Then, if the confirmation key 31*r* displayed on the authorization failure screen is depressed, the authorization request screen of FIG. 12 is displayed again on the liquid crystal touch panel 31. If a prescribed time period has elapsed without any operation, a copy operation is recommenced, and the authorization failure screen is closed.

The copy interruption screen prompts an operator to determine if a copy operation interrupted by depressing the clear/stop (C/S) key 33 is to be continued. If an operation absence condition continues for a prescribed time period while the copy interruption screen of FIG. 14 is displayed, the copy interruption screen is closed, and a copy operation is recommenced. Further, the cancel or stop key 31*t* displayed on the copy interruption screen of FIG. 14 is depressed, the copy operation is interrupted, and a new copy operation is possible. If the continue key 31*s* displayed on the copy interruption screen is depressed, the copy operation is recommenced.

As mentioned heretofore, it is determined if the copying is running in step S2. However, sheet feeding can be interrupted (in step S3), when the clear/stop (C/S) key 33 is depressed (in step S1) without executing such a determination. Further, as mentioned above, when it is determined that the authorization executing key 31*p* is not depressed in step S7 (No, in step S7), it is determined if a prescribed time period has elapsed after the timer starts timing in step S8. However, it can also be determined if none of operations are performed on the authorization request screen and a prescribed time period has elapsed after the timer starts timing. The above-mentioned prescribed time period ($\alpha$) in steps S8, S15, and S22 can be optionally changed. Further, instead of displaying the authorization failure screen, either a buzzer can be rung or an alarm lamp can be blinked to inform the failure of the authorization. Further, a number of counted seconds can be displayed on the liquid crystal touch panel 31. As mentioned above, the authorization failure screen is displayed on the liquid crystal touch panel 31, when the determination is negative in step S11 (No, in step S11). Even when the determination is positive in step S11, information related to the image formation job, which is registered in connection with the user name and password, can be displayed.

Further, to match with a user name and a password, entry information, which is registered and administrated by a user administrative table, can be utilized. Specifically, as shown in FIG. 15, a user administrative table may include couples of a user name and a corresponding password associated with each of the image formation jobs to be performed by the image forming apparatus. Otherwise, as illustrated in FIG. 16B, the administrative table may contain various couples of a user name and a corresponding password in connection with each of user IDs, so that various image formation jobs reserved can be administrated in connection with the user IDs.

A second embodiment is now described with reference to FIG. 17. In the second embodiment, a print interruption or stop key is provided on the operation section 30. An image formation job in execution of printing is interrupted and an authorization request screen is displayed to interrupt the image formation job when the print interruption key is depressed. If a user name and a password input through the authorization request screen match with those having been registered in connection with an image formation job in execution, the image formation job is interrupted. Thus, an operation necessary for interrupting the image formation job can be simplified.

Figures 10, 10A, 10B:
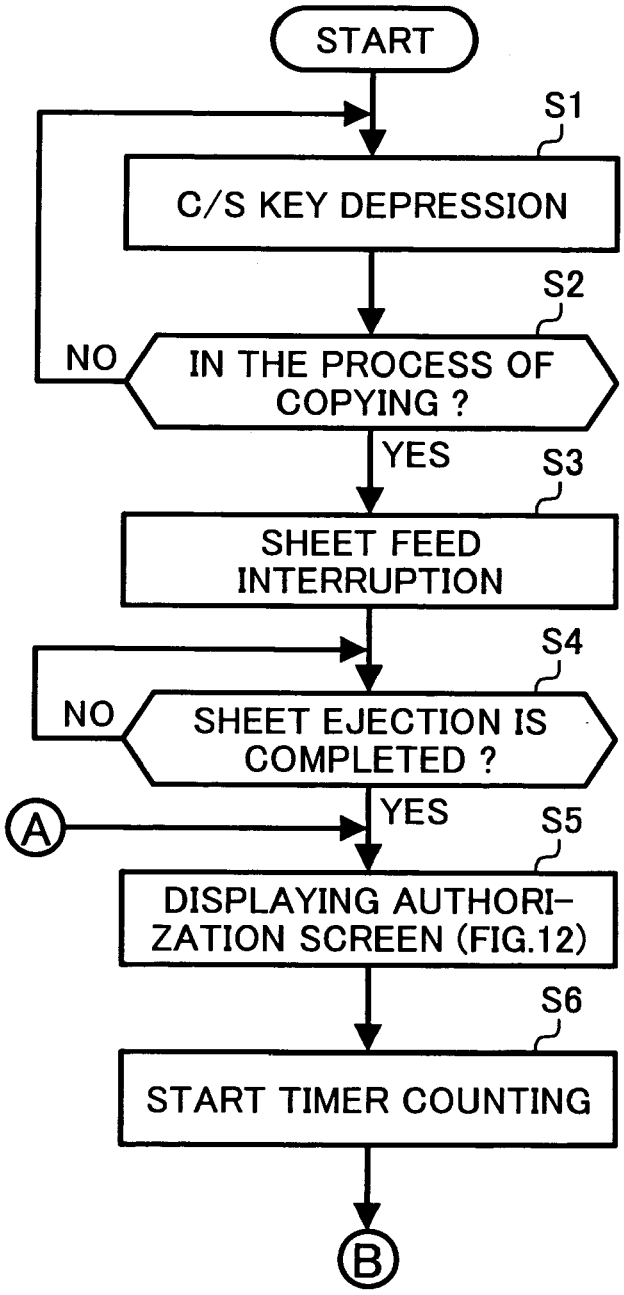
FIGS. 10A and 10B collectively illustrate a first operation of an interruption performed in the image forming apparatus of FIG. 1 according to the present invention.
Figure 10B:
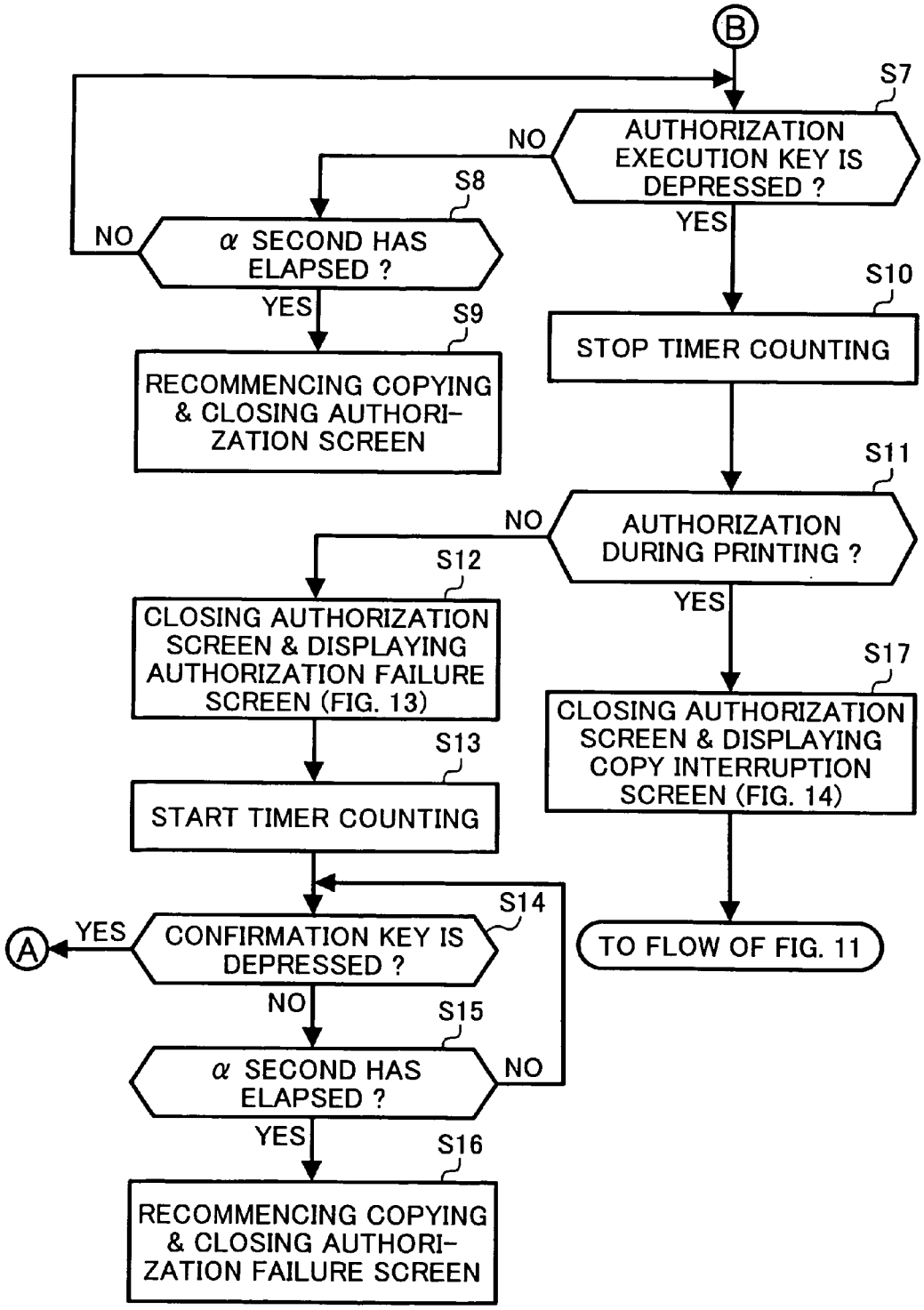
Figures 17, 17A, 17B:
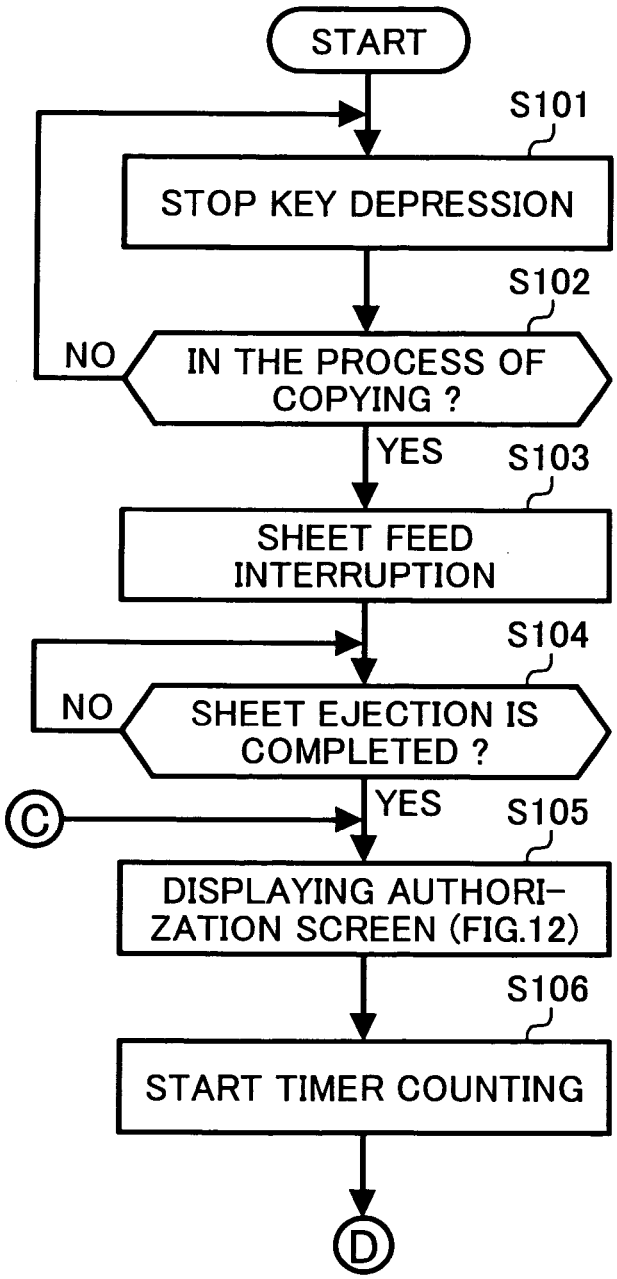
FIGS. 17A and 17B collectively illustrate an exemplary operation sequence performed in the image forming apparatus of FIG. 1 according to a second embodiment of the present invention.
Figure 17B:
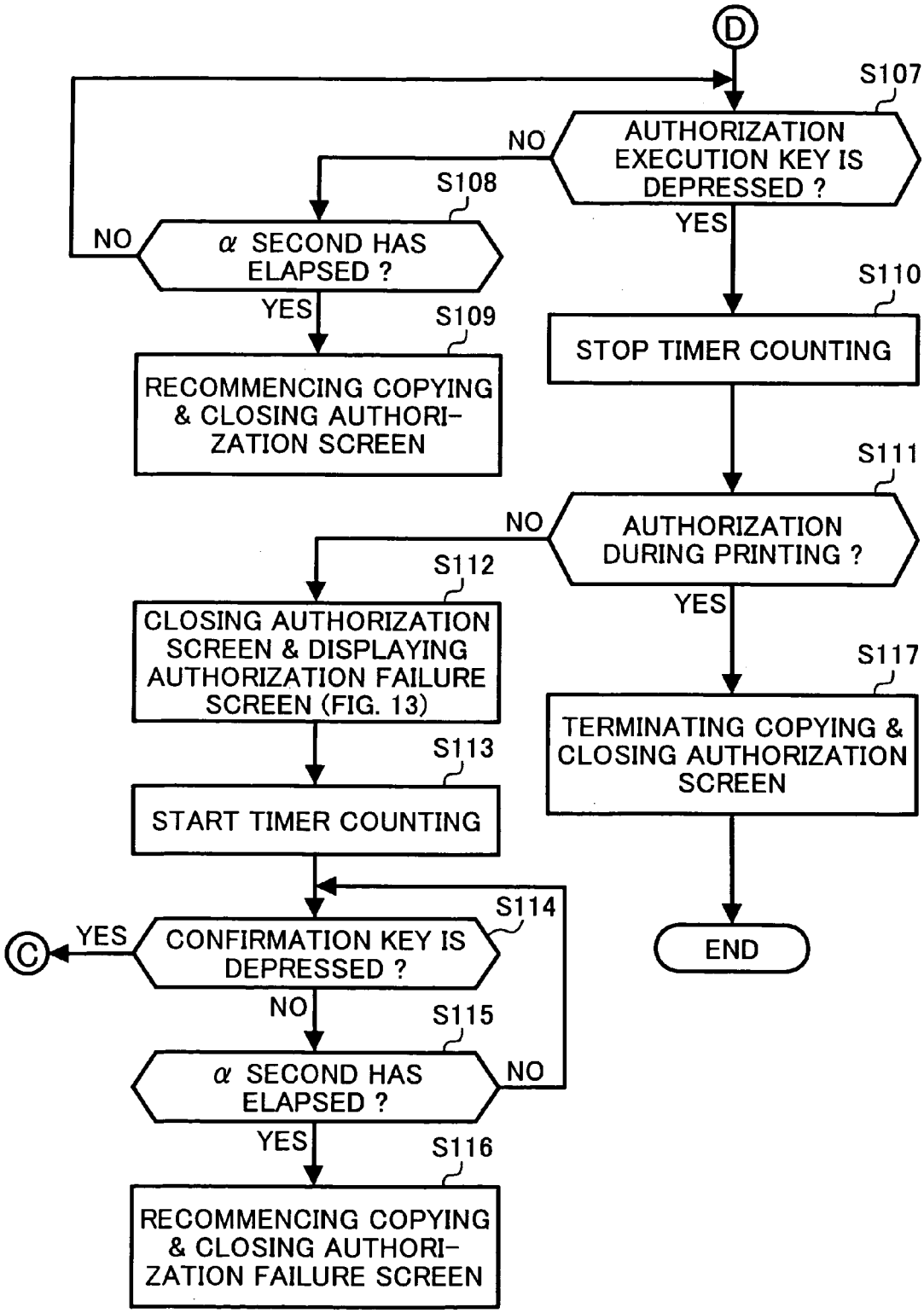

The following description notes differences between the embodiment of FIG. 17 and that of FIGS. 10–11 , and the steps not discussed correspond to those executed in FIGS. 10–11. Specifically, as shown in FIG. 17, when it is detected that the print interruption key is depressed (in step S101), the main controller 20 interrupts sheet feeding of an image formation job in execution of printing (in step S103), and displays an authorization request screen of FIG. 12 on a liquid crystal touch panel 31 to interrupt the image formation job (in step S105). If a user name and a password input through the authorization request screen match with those having been registered in connection with the running image formation job (Yes, in step S111), the image formation job in execution of printing is interrupted, a copying operation is completed, and the authorization request screen is closed (in step S117). As a result, an operation for interrupting an image formation job in execution of printing can be simplified.

A third embodiment is now described with reference to FIG. 18. A condition change key is provided on the operation section 30, and an image formation job in execution of printing is interrupted and an authorization request screen is displayed to interrupt and change contents of the image formation job when the condition change key is depressed.

Figures 18, 18A, 18B:
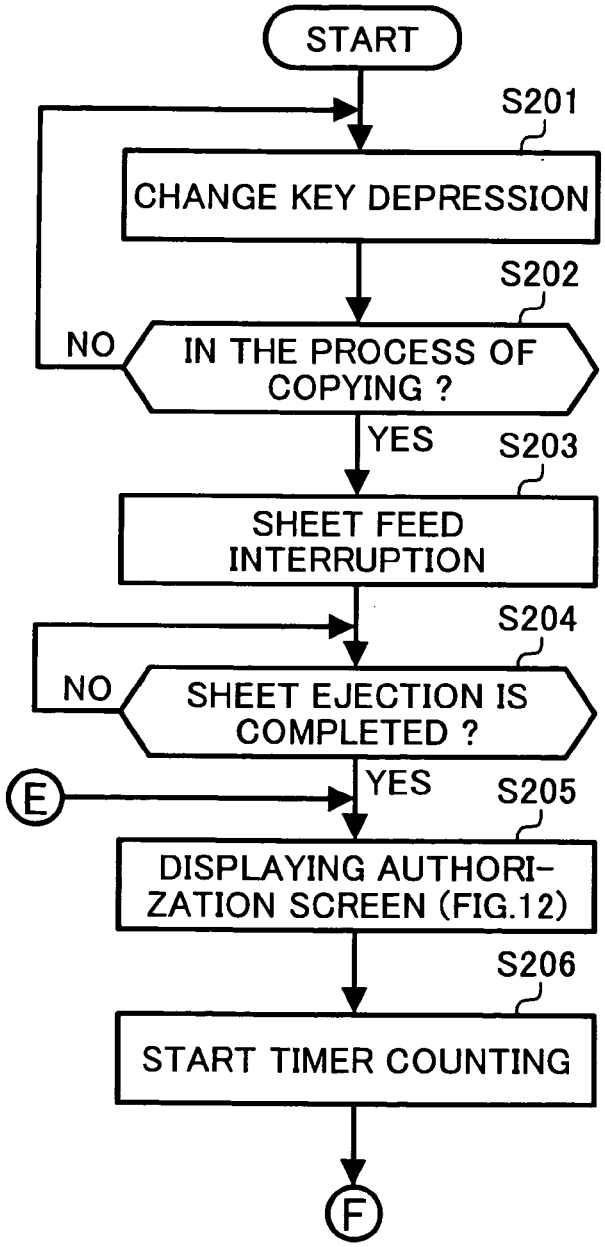
FIGS. 18A and 18B collectively illustrate an exemplary operation sequence performed in an image forming apparatus of FIG. 1 according to a third embodiment of the present invention.
Figure 18B:
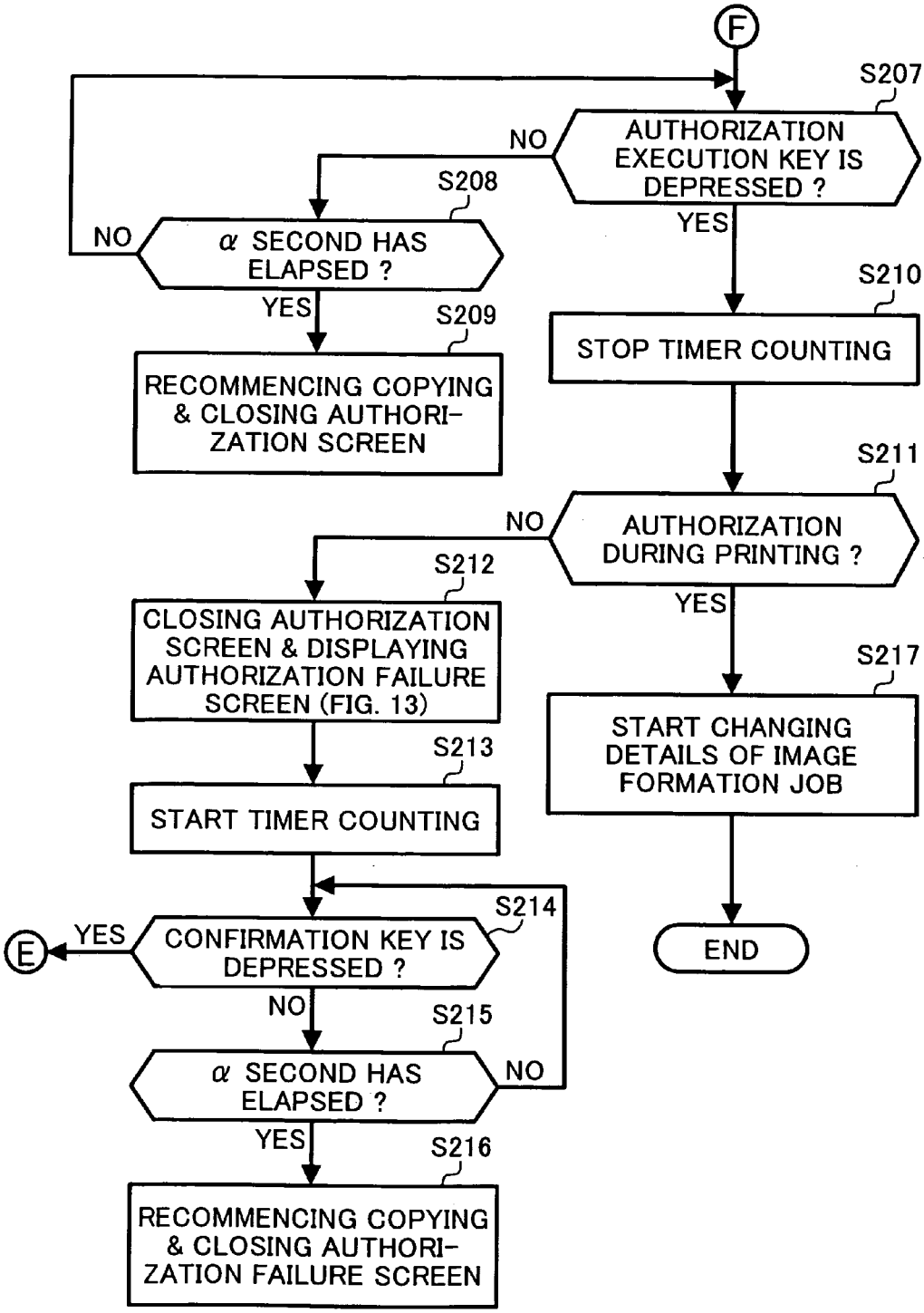

The following description notes differences between the embodiment of FIG. 18 and that of FIGS. 10–11, and the steps not discussed correspond to those executed in FIGS. 10–11. Specifically, as shown in FIG. 18, when detecting that the condition change key is depressed (in step S201), the main controller 20 interrupts sheet feeding of an image formation job in execution of printing (in step S203), and displays an authorization request screen of FIG. 12 on a liquid crystal touch panel 31 to change contents of the image formation job (in step S205). Then, if a user name and a password input through the authorization request screen match with those having been registered in connection with the running image formation job (Yes, in step S211), a job content changing screen is displayed for an operator to change contents of the image formation job. When such a changing operation is completed, the main controller 20 starts printing of the changed image formation job (in step S217). Thus, the contents of the image formation job in execution of printing can be changed and performed in accordance with the change. In the above-mentioned operation, when the changing operation is completed (in step S217), a copy interruption screen of FIG. 14 can be displayed on the liquid crystal touch panel, and a printing operation can be either started in accordance with the changed image formation job using a continue key, or cancelled using a cancel key, like operations performed in steps S17 to S23.

Now, a fourth embodiment is described with reference to FIGS. 19–21. A selecting key is provided to select one of functions of an interruption operation key (clear/stop key) to interrupt an image formation job in execution of printing as described in the first embodiment, and a condition change key 31*u* is provided to change contents of an image formation job in execution of printing as described in the third embodiment. Accordingly, one of operations, such as interruption, continuation, a change in contents, etc., of an image formation job can be optionally selected by one operation key without employing operation keys as used in the first and third embodiments.

Figures 19, 19A, 19B:
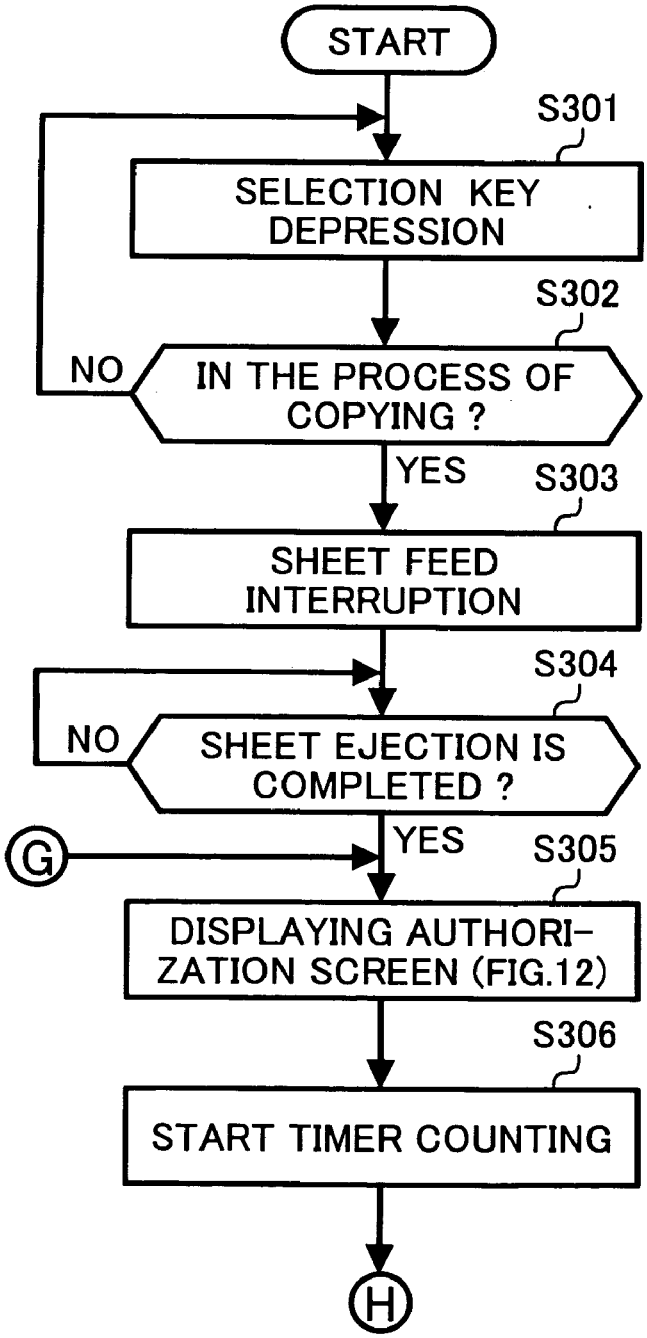
FIGS. 19A and 19B collectively illustrate a first exemplary operation sequence performed in the image forming apparatus of FIG. 1 according to a fourth embodiment of the present invention.
Figure 19B:
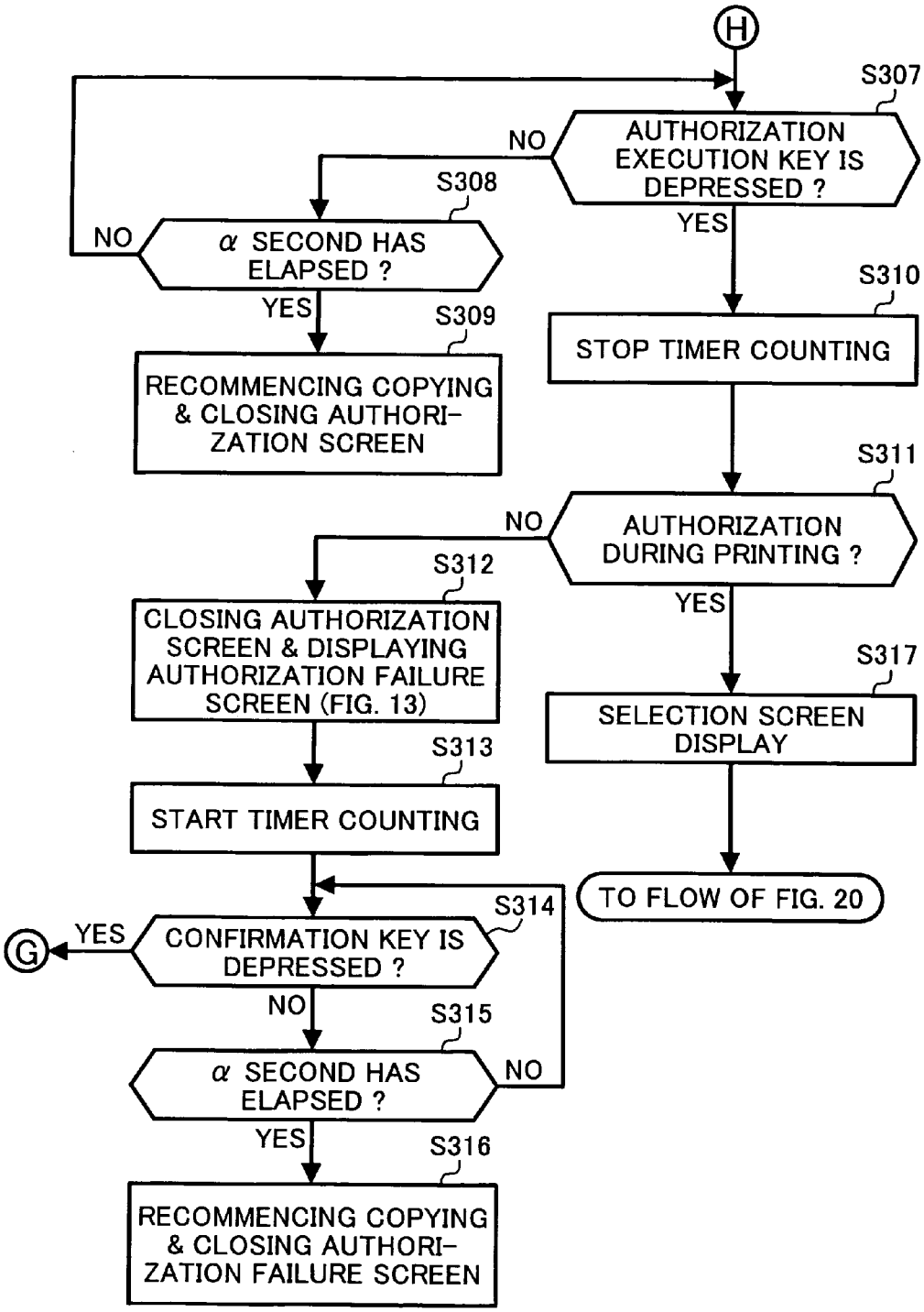
Figure 20:
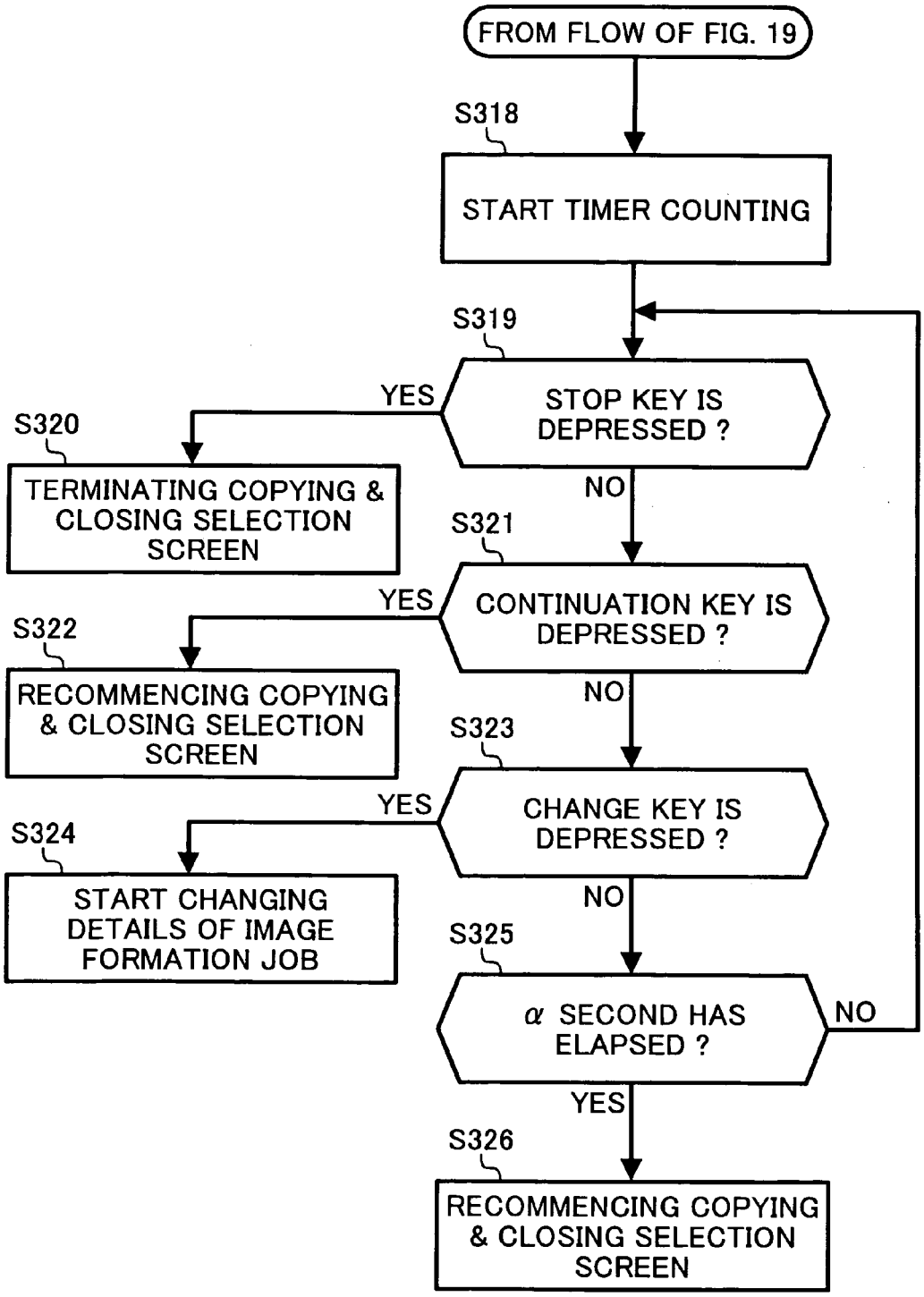
FIG. 20 illustrates a second exemplary operation sequence performed in the image forming apparatus of FIG. 1 according to a fourth embodiment of the present invention.
Figure 21:
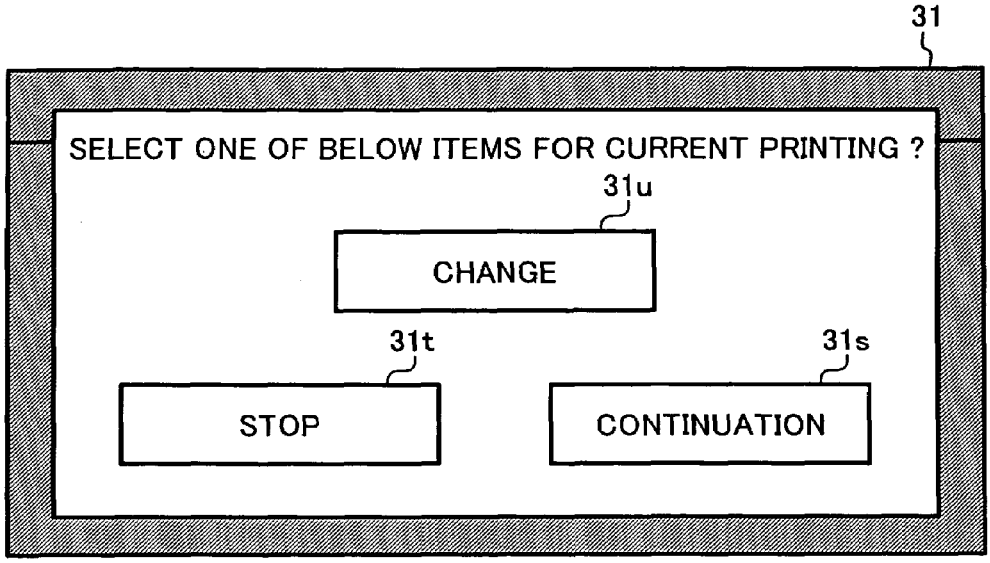
FIG. 21 illustrates an exemplary selection screen displayed on the liquid crystal touch panel of FIG. 3 when an operation is executed in the image forming apparatus of FIG. 1 according to the fourth embodiment of the present invention.

The following description notes differences between the embodiment of FIG. 19–21 and that of FIGS. 10–11, and the steps not discussed correspond to those executed in FIGS. 10–11. Specifically, as shown in FIG. 19, if it is detected that the selecting key is depressed (in step S301), the main controller 20 interrupts an image formation job in execution of printing (in step S303), and displays an authorization request screen of FIG. 12 on a liquid crystal touch panel 31 (in step S305). If a user name and a password input through the authorization request screen match with those having been registered in connection with the running image formation job (Yes, in step S311), a selection screen is displayed for an operator to select one of a continuing key 31*s*, which continues an image formation job in execution of printing, an interruption key or stop 31*t*, which interrupts the image formation job, and a condition change key 31*u*, which changes contents of the image formation job, on a liquid crystal touch panel 31 as shown in FIG. 21 (in step S317).

Then, as shown in FIG. 20, the main controller 20 starts timing (in step S318), and determines if the interruption or stop key 31*t* is depressed (in step S319). If the determination is positive (Yes, in step S319), the main controller 20 stops timing, and interrupts and completes the copy operation. The main controller 20 then closes the selection screen of FIG. 21, and recalls the display screen of FIG. 2.

In contrast, if the determination in step S319 is negative (No, in step S319), the main controller 20 determines if the continuing key 31*s* is depressed (in step S321). If the determination is positive (Yes, in step S321), the main controller 20 stops timing, and commences the copy operation. Further, the main controller 20 closes the selection screen of FIG. 21, and recalls the display screen of FIG. 2 on the liquid crystal touch panel 31 (in step S322).

In contrast, if the determination in step S321 is negative (No, in step S321), the main controller 20 determines if the change key 31*u* displayed on the selection screen of FIG. 21 is depressed (in step S323). If the determination is positive (Yes, in step S323), the main controller 20 displays the changing screen so that an operator can change the image formation job. Then, the main controller 20 starts a printing operation in accordance with the changed image formation job (in step S324). When the changing operation is completed (in step S324), a copy interruption screen of FIG. 14 can be displayed on the liquid crystal touch panel 31, and a printing operation can be either started in accordance with the changed image formation job using a continue key, or is cancelled using a cancel key, as in operations performed in steps S17 to S23.

If the determination in step S323 is negative (No, in step S323), the main controller 20 determines if a prescribed time has elapsed after the timer starts (in step S325). If the determination is negative (No, in step S325), the process returns to step S319, and the main controller 20 determines if the cancel or stop key 31*t* is depressed (in step S319).

In contrast, if the determination in step S325 is positive (Yes, in step S325), the main controller 20 stops the timing, and recommences a copying operation. The main controller 20 then closes the selection screen, and recalls the display screen of FIG. 2 (in step S326). Thus, with the change key 31*u*, one of operations, such as interruption, continuation, and a change in contents, of an image formation job in execution of printing, can be optionally selected only by one operation key without plural operation keys as used in the first and third embodiments.

Even though the above-mentioned several embodiments are implemented in one image forming apparatus, they can be implemented in a multi-function image formation system formed by combining a plurality of image forming apparatuses. Further, the above-mentioned various operations can be achieved by executing a prescribed computer program, installed in a memory of the image forming apparatus. For example, by storing such a program in one of optical, magnetic, optical magnetic, and semiconductor recording mediums, and reading it in the image forming apparatus, the above-mentioned several operations can be performed. Otherwise, downloading and reading such a program from an external instrument to an image forming apparatus via a network can perform the above-mentioned several operations.

The present invention can also be applied to an information processing apparatus, which employs an operation device that allows various operations and executes a plurality of programs. In particular, the present invention can preferably be applied to an information processing apparatus in which a first program becomes available when completed and a second program is running.

Obviously, numerous additional modifications and variations of the present invention are possible in light of the above teachings. It is therefore to be understood that within the scope of the appended claims, the present invention may be practiced otherwise than as specifically described herein.

The invention claimed is:

1. An image forming apparatus, comprising:

means for storing and administering authorization information in connection with an image formation job, said authorization information being used in authorizing an operator to apply a prescribed operation to a prescribed image formation job;

means for executing the image formation job;

means for requesting the operator to input identification information while temporarily stopping execution of the image formation job in progress, for performing authorization based upon the input identification information, and for forwarding an authorization; and means for validating the prescribed operation when the authorization is forwarded.

2. The image forming apparatus as claimed in claim 1, wherein said prescribed operation is applied to the image formation job by an operational device, and wherein the means for requesting requests the operator to input the authorization information when the operational device starts applying the prescribed operation.

3. The image forming apparatus as claimed in claim 1, wherein the prescribed operation includes at least one of a print interruption operation to interrupt the image formation job, a continuing operation to continue the image formation job, and a content changing operation to change contents of the prescribed image formation job.

4. The image forming apparatus as claimed in claim 3, further comprising means for recommencing the image formation job when the content changing operation is executed.

5. The image forming apparatus as claimed in claim 1, wherein the prescribed operation includes selection of one of a print interruption operation for interrupting the image formation job, a continuing operation for continuing the image formation job, and a content changing operation for changing contents of the image formation job.

6. The image forming apparatus as claimed in claim 1, wherein said means for recommencing recommences the image formation job when a prescribed time period has elapsed after the means for requesting requests the operator to input the identification information, and the means for forwarding does not forward the authorization within a prescribed time.

7. The image forming apparatus as claimed in claim 6, further comprising means for setting a prescribed time period for recommencing the image formation job.

8. The image forming apparatus as claimed in claim 1, further comprising means for outputting an alarm that the authorization is rejected when the means for forwarding does not forward the authorization.

9. The image forming apparatus as claimed in claim 1, wherein said authorization device determines if the identification information matches with the authorization information, wherein the authorization is forwarded when the identification information matches with the authorization information, and is not forwarded when the identification information does not match with the authorization information.

10. An image forming apparatus, comprising:

an administrative device configured to store and administrate authorization information in connection with an image formation job, said authorization information being used in authorizing an operator to apply a prescribed operation to a prescribed image formation job;

an image forming device configured to execute the image formation job;

an authorization device configured to request the operator to input identification information while temporarily stopping execution of the image formation job in progress, to perform authorization based upon the input identification information, and to forward an authorization; and a control device configured to validate the prescribed operation when the authorization device forwards the authorization.

11. The image forming apparatus as claimed in claim 10, wherein said prescribed operation is applied to the image formation job by an operational device, and wherein the authorization device requests the operator to input the authorization information when the operational device starts applying the prescribed operation.

12. The image forming apparatus as claimed in claim 10, wherein the prescribed operation includes at least one of a print interruption operation to interrupt the image formation job, a continuing operation to continue the image formation job, and a content changing operation to change contents of the prescribed image formation job.

13. The image forming apparatus as claimed in claim 12, further comprising a recommencing device configured to recommence the image formation job when the content changing operation is executed.

14. The image forming apparatus as claimed in claim 10, wherein the prescribed operation includes selection of one of a print interruption operation for interrupting the image formation job, a continuing operation for continuing the image formation job, and a content changing operation for changing contents of the image formation job.

15. The image forming apparatus as claimed in claim 10, wherein said recommencing device recommences the image formation job when a prescribed time period has elapsed after the authorization device requests the operator to input the identification information, and the authorization device does not forward the authorization within a prescribed time.

16. The image forming apparatus as claimed in claim 15, further comprising a time period setting device configured to set a prescribed time period for recommencing the image formation job.

17. The image forming apparatus as claimed in claim 10, further comprising an alarm configured to output an alarm that the authorization is rejected when the authorization device does not forward the authorization.

18. The image forming apparatus as claimed in claim 10, wherein said authorization device determines if the identification information matches with the authorization information, wherein the authorization is forwarded when the identification information matches with the authorization information, and is not forwarded when the identification information does not match with the authorization information.

19. A computer program read by a computer provided in an image forming apparatus for establishing a security of a reservation job, said computer program performing:

receiving a request for applying a prescribed operation to a reserved job from an operator;

requesting the operator to input identification information;

temporarily stopping execution of the reserved job;

performing authorization based upon the input identification information, and forwarding authorization; and validating the prescribed operation when the authorization is forwarded.

20. A computer readable recording medium configured to the store the computer program as claimed in claim 19.

* * * * *